US011493293B2

(12) United States Patent
Brown et al.

(10) Patent No.: US 11,493,293 B2
(45) Date of Patent: Nov. 8, 2022

(54) MAGAZINE FOR FIREARM

(71) Applicant: Sturm, Ruger & Company, Inc., Southport, CT (US)

(72) Inventors: Nathan Brown, Kernersville, NC (US); Dwight Potter, Centennial, WY (US)

(73) Assignee: STURM, RUGER & COMPANY, INC.

( * ) Notice: Subject to any disclaimer, the term of this patent is extended or adjusted under 35 U.S.C. 154(b) by 28 days.

(21) Appl. No.: 17/030,693

(22) Filed: Sep. 24, 2020

(65) Prior Publication Data

US 2021/0231396 A1 Jul. 29, 2021

Related U.S. Application Data

(60) Provisional application No. 62/905,545, filed on Sep. 25, 2019.

(51) Int. Cl.
*F41A 9/70* (2006.01)
*F41A 9/66* (2006.01)

(52) U.S. Cl.
CPC . *F41A 9/66* (2013.01); *F41A 9/70* (2013.01)

(58) Field of Classification Search
CPC ..... F41A 9/66; F41A 9/69; F41A 9/70; F41A 11/00; F41A 9/65; F41A 9/24; F41A 9/25; F41A 9/61; F41A 9/62; F41A 9/00; F41A 15/00; F41A 15/16; F41A 17/00
USPC ..... 42/50, 49.01, 7, 49.02, 6
See application file for complete search history.

(56) References Cited

U.S. PATENT DOCUMENTS 3,732,643 A * 5/1973 Wells ..... F41A 17/38 42/50
4,155,187 A * 5/1979 Lichtman ..... F41A 9/47 42/11
4,516,346 A * 5/1985 Farrar ..... F41A 9/67 42/50
4,592,160 A 6/1986 Bross et al.
5,438,783 A 8/1995 Sniezak et al.
5,566,487 A 10/1996 Vaid et al.
5,642,582 A 7/1997 Grams
(Continued)

OTHER PUBLICATIONS

Wilson Combat, Vickers Tactical—Magazine Floor Plate, https://shopwilsoncombat.com/Vickers-Tactical-Magazine-Floor-Plate-for-Glock-5-Pack/productinfo/NW361/; retrieved Nov. 11, 2018, p. 1.
(Continued)

*Primary Examiner* — Michael D David
(74) *Attorney, Agent, or Firm* — The Belles Group, P.C.

(57) ABSTRACT

A magazine for a firearm comprises a tubular magazine body defining a cavity for holding cartridges, a spring, and a follower biased by the spring for dispensing cartridges from the magazine. A spring base disposed on the body includes a cantilevered resiliently deformable spring arm supporting the spring in one embodiment. The base is held in place by the floor plate. Sliding the floor plate onto the magazine body engages an inclined ramp of the floor plate with spring arm which automatically moves the spring arm from an undeflected to deflected position. When the floor plate is fully coupled to the magazine tube such that the spring arm clears the ramp, the spring arm snaps back to the undeflected position and locks the floor plate in place on the tubular body via interlocked retention features without use of tools.

30 Claims, 32 Drawing Sheets

(56) References Cited

U.S. PATENT DOCUMENTS

| | | | | |
|---|---|---|---|---|
| 5,906,065 | A | 5/1999 | Pearce | |
| 6,568,115 | B2 | 5/2003 | Beretta | |
| D487,791 | S | 3/2004 | Freed | |
| 6,928,764 | B2 | 8/2005 | Freed | |
| 7,069,683 | B1 * | 7/2006 | Kapusta | F41A 17/36 89/190 |
| 7,117,622 | B2 | 10/2006 | Freed | |
| 7,318,294 | B2 * | 1/2008 | Zimmermann | F42B 5/025 42/50 |
| D576,701 | S | 9/2008 | Nichols | |
| 7,509,767 | B2 | 3/2009 | Bolen | |
| D593,634 | S | 6/2009 | Fitzpatrick et al. | |
| 8,069,601 | B1 | 12/2011 | Fitzpatrick et al. | |
| 8,646,200 | B2 | 2/2014 | Rendulic | |
| D706,895 | S | 6/2014 | Zayatz et al. | |
| 8,863,423 | B2 | 10/2014 | Clifton, Jr. et al. | |
| 8,925,231 | B2 | 1/2015 | Lee | |
| D745,944 | S | 12/2015 | Kielsmeier et al. | |
| D757,884 | S | 5/2016 | Kielsmeier et al. | |
| D769,397 | S | 10/2016 | Lam et al. | |
| 9,772,151 | B1 | 9/2017 | Sanderson et al. | |
| 10,048,030 | B2 | 8/2018 | Corso | |
| 10,101,105 | B1 | 10/2018 | Novak et al. | |
| 10,113,820 | B1 | 10/2018 | Jarratt | |
| 10,401,105 | B2 * | 9/2019 | Dowling | F41A 9/71 |
| 10,508,874 | B2 * | 12/2019 | Headrick | F41A 35/06 |
| 10,641,565 | B2 * | 5/2020 | Nakayama | F41A 9/70 |
| 10,801,792 | B2 * | 10/2020 | Pini | F41A 9/65 |
| 10,809,028 | B2 * | 10/2020 | Underwood | F41A 9/65 |
| 10,996,010 | B2 * | 5/2021 | Cass | F41A 9/65 |
| 11,054,202 | B1 * | 7/2021 | Underwood | F41A 9/70 |
| 11,067,351 | B2 * | 7/2021 | Underwood | F41A 9/70 |
| 11,092,397 | B2 * | 8/2021 | Müller | F41A 9/66 |
| 11,112,193 | B2 * | 9/2021 | O'Clair | F41A 9/65 |
| 2013/0333261 | A1 | 12/2013 | Clifton, Jr. et al. | |
| 2014/0020275 | A1 | 1/2014 | Corso | |
| 2015/0241152 | A1 | 8/2015 | Fitzpatrick et al. | |
| 2016/0282071 | A1 | 9/2016 | Vilardi et al. | |
| 2017/0160038 | A1 | 6/2017 | Keng et al. | |
| 2018/0209753 | A1 | 7/2018 | Faifer | |

OTHER PUBLICATIONS amazon.com, Mantis MantisX MagRail, Glock Double Stack 9mm,Magazine Floor Plate Rail Adapter, https://www.amazon.com/MantisX-MagRail-Double-Magazine-Adapter/dp/B076HZQ9F8; retrieved Nov. 20, 2018, p. 1.

Sturm, Ruger & Co, Inc., Ruger LCPII Lightweight Compact Pistol Instruction Manual, (Aug. 2020), pp. 1-36.

International Search Report and Written Opinion for International Application No. PCT/US20/52410 dated Dec. 10, 2020.

* cited by examiner

MAGAZINE FOR FIREARM

CROSS-REFERENCE TO RELATED APPLICATIONS

The present application claims the benefit of priority to U.S. Provisional Application No. 62/905,545 filed Sep. 25, 2019; the entirety of which is incorporated herein by reference.

BACKGROUND

The present invention generally relates to firearms, and more particularly to ammunition magazines detachably mounted to firearms.

Ammunition magazines for firearms are designed to conveniently store and feed multiple rounds of shells or cartridges. Such magazines have a spring mechanism which automatically dispenses the cartridges into the firearm for firing and are used in many different types of firearm platforms, including shotguns, rifles, and pistols. One type of magazine used is a box style magazine, which may be removably detached to the underside of the firearm below the action. These magazines hold a plurality of vertically stacked cartridges. When the action is cycled and the spent shell or cartridge casing is ejected, a fresh cartridge is uploaded by the spring mechanism into the breech area from which the bolt or breech block loads the cartridge forward into the chamber of the barrel for firing.

For compact firearms such as semi-automatic pistols intended for concealed carry, it is desirable to make magazines as compact as possible and with a reduced profile while maximizing the cartridge carrying capacity of the magazine.

SUMMARY

The present disclosure provides a compact ammunition magazine for a firearm. In one non-limiting example, the magazine may be configured of use in a semiautomatic pistol; however, the magazine can also be used in long guns such as shotguns or rifles in other embodiments. The magazine provides a reduced profile detachable floor plate and related retention system which contributes to an overall compact pistol design that can be readily holstered and concealed for carry. The magazine offers a more positive floor plate retention mechanism conveniently requiring no tools for assembly. An automatic snap interlock is formed between the floor plate and spring base when the magazine is assembled. An off-axis magazine spring placement maintains the positive interlock while biasing a stack of cartridges towards the feed lips at the open top end of the tubular magazine body. Disassembly requires only a suitable thin elongated shaft or rod-like push tool such as a screwdriver tip, pin punch, or similar device to disengage the interlock and remove the floor plate and other components.

In one aspect, a magazine for a firearm comprises: an elongated tubular body defining a vertical centerline and an interior cavity configured to hold a stack of ammunition cartridges, the tubular body including a top end, a bottom end, a front wall, a rear wall, and opposed lateral sidewalls extending between the front and rear walls; a spring disposed in the cavity; a follower moveably disposed in the cavity and biased in an upwards direction towards the top end by the spring; a spring base detachably positioned on the bottom end of the tubular body, the spring base comprising a cantilevered spring arm supporting the spring, the spring arm being resiliently deformable between an undeflected position and a deflected position; and a floor plate slideably engageable with the bottom end of the body which retains the spring base on the tubular body; wherein the floor plate is configured to automatically move the spring arm from the undeflected position to the deflected position when the floor plate is slid onto the bottom end of the tubular body. In one embodiment, the floor plate includes an inclined ramp operable to slideably engage and raise the spring arm from the undeflected position to the deflected position when the floor plate is slid onto the bottom of the tubular body.

In another aspect, a firearm comprises: a longitudinal axis; a frame defining a magazine well; a magazine comprising: a tubular body defining a vertical centerline and an interior cavity configured to hold a stack of ammunition cartridges; a helical compression spring defining a spring axis offset from the vertical centerline of the tubular body; a follower moveably disposed in the cavity and biased in an upwards direction towards a top end of the tubular body by the spring; a spring base detachably positioned on a bottom end of the tubular body, the spring base comprising a rear portion defining a pivot axis and cantilevered spring arm engaging the spring and extending forwardly from the rear portion, the spring arm being resiliently deformable between an undeflected position and a deflected position; and a floor plate slideably engageable with a bottom end of the tubular body and the spring base; wherein the spring arm is biased into engagement with the floor plate by the spring.

In another aspect, a method for assembling a firearm magazine comprises: providing an elongated tubular magazine body defining a vertical centerline axis and an interior cavity configured to hold a spring-biased stack of ammunition cartridges, the magazine tube comprising a top end, a bottom end, a front wall, a rear wall, and a pair of opposing lateral sidewalls; inserting a follower and a spring into the cavity of the magazine body; positioning a spring base on the bottom of the magazine body, the spring base comprising a resiliently deformable spring arm defining a spring seating surface which engages the spring; sliding a floor plate onto the bottom end of the magazine body in a horizontal direction; automatically raising the spring arm from an undeflected position to a deflected position via engagement with an inclined ramp of the floor plate; breaking engagement between the inclined ramp and spring arm; and snap locking the spring arm into a recessed receptacle of the floor plate; wherein the floor plate cannot be withdrawn from the magazine body in the horizontal direction.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The features of the exemplary embodiments will be described with reference to the following drawings where like elements are labeled similarly, and in which.

Figure 1:
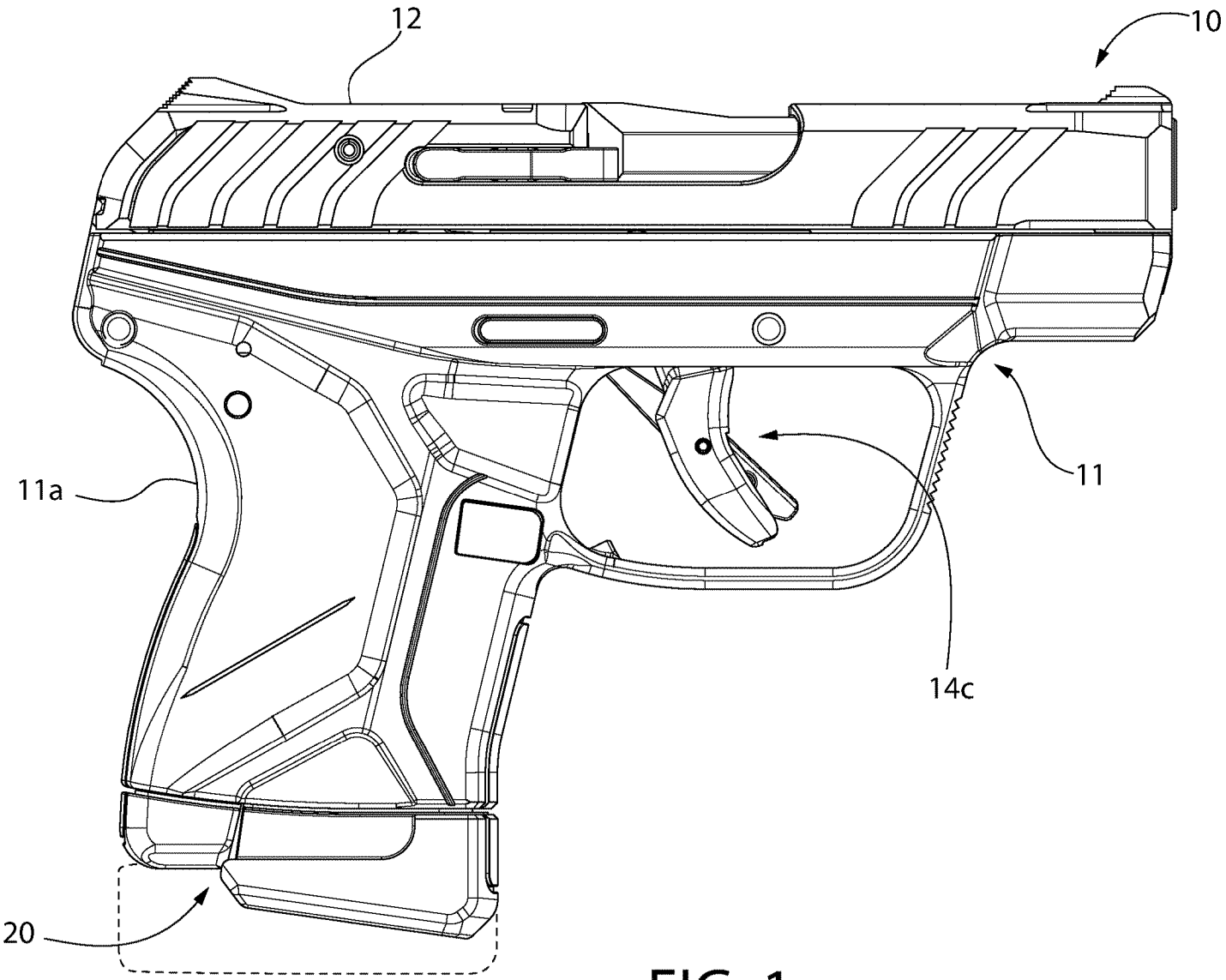
FIG. 1 is a right side of a firearm comprising a magazine according to the present disclosure.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The terms "shell" and "cartridge" may be used interchangeably herein in reference to describing ammunition, and therefore should not be construed as limiting the invention or the claims appended hereto. For convenience and brevity, further description of ammunition which follows will generally use the non-limiting term of "cartridge."

As used throughout, any ranges disclosed herein are used as shorthand for describing each and every value that is within the range. Any value within the range can be selected as the terminus of the range. In addition, any references which may be cited herein are all hereby incorporated by reference in their entireties. In the event of a conflict in a definition or meaning of a term in the present disclosure and that of a cited reference, the present disclosure controls.

A detachable firearm magazine according to a non-limiting embodiment of the present disclosure to be described may be used in autoloading firearm such as a semi-automatic pistol which is illustrated, or long guns such as rifles or shotguns, or other types of autoloading firearms. The type of autoloading firearm does not limit the scope or applicability of the invention.

FIGS. 1 and 2 show one non-limiting embodiment of a semi-automatic pistol 10 which includes a detachable box style compact magazine 20 according to the present disclosure. Pistol 10 includes longitudinal axis LA, a frame 11 supporting a reciprocating slide 12, barrel 16 supported by and carried in a longitudinally-extending cavity 12*a* of the slide, and a firing mechanism 14 configured and operable to discharge the firearm. Barrel 16 includes front muzzle end 14*a*, rear breech end 16*b*, and an enlarged cartridge-receiving chamber adjacent the breech end which is configured to hold a cartridge 30. Longitudinally-extending axial bore 16*d* formed in barrel 16 is in communication with chamber 16*c* and defines a projectile passageway. The axial centerline of barrel bore 16*d* defines longitudinal axis LA.

Pistol 20 may be hammer-fired in one embodiment. Firing mechanism 14 is configured and operable to automatically cycle the action to discharge a chambered cartridge C, extract and eject the spent or empty cartridge casing from the chamber and firearm, and load or chamber a fresh cartridge automatically dispensed by magazine 20. The firing mechanism may be supported by frame 11. Firing mechanism 14 may include a trigger mechanism 14*c* which cooperates with a rotatable sear 14*b* and spring biased striking member which may be a pivotably movable hammer 14*a* acted upon by hammer spring 14*d* carried by frame 11, as shown. The hammer 14*a* cooperates with a spring-biased firing pin 13 carried by the slide.

Pistol 20 may function in the conventional manner well known in the art to discharge the firearm. In operation, with a rearward cocked hammer held in position by sear 14*b*, pulling the trigger 14*e* of trigger mechanism 14*c* mechanism rearwards rotates sear 14*b* which releases the hammer 14*a* forward to strike the firing pin 13. The firing pin is in turn driven forward to strike the chambered cartridge 30 and discharge the firearm.

In other possible embodiments, the pistol may be striker-fired comprising a spring biased linear acting striker in lieu of the hammer and firing pin to strike the chambered cartridge and discharge the firearm. Accordingly, the magazine 20 is expressly not limited in use or applicability to either hammer-fired or striker-fired firearms.

FIGS. 3-43 show the magazine 20 and components thereof in isolation removed from the firearm for clarity of depiction.

With additional reference now to FIGS. 3-43, magazine 20 has a vertically elongated open tubular housing or body 21 that defines an internal cavity 22 configured for holding a plurality of cartridges 30. The cartridges may be held in vertically stacked relationship comprised of either a straight column or stack (i.e. each cartridge is vertically aligned with the rest of the cartridges above/below in the stack, shown in FIG. 2), staggered column or stack (i.e. each cartridge is laterally offset slightly from the preceding cartridge above/below), or a combination thereof where a staggered stack ends and transitions into a single stack near the top of the magazine for dispensing. All of the foregoing possible cartridge stack configurations arrangement are well known in the art.

Figure 2A:
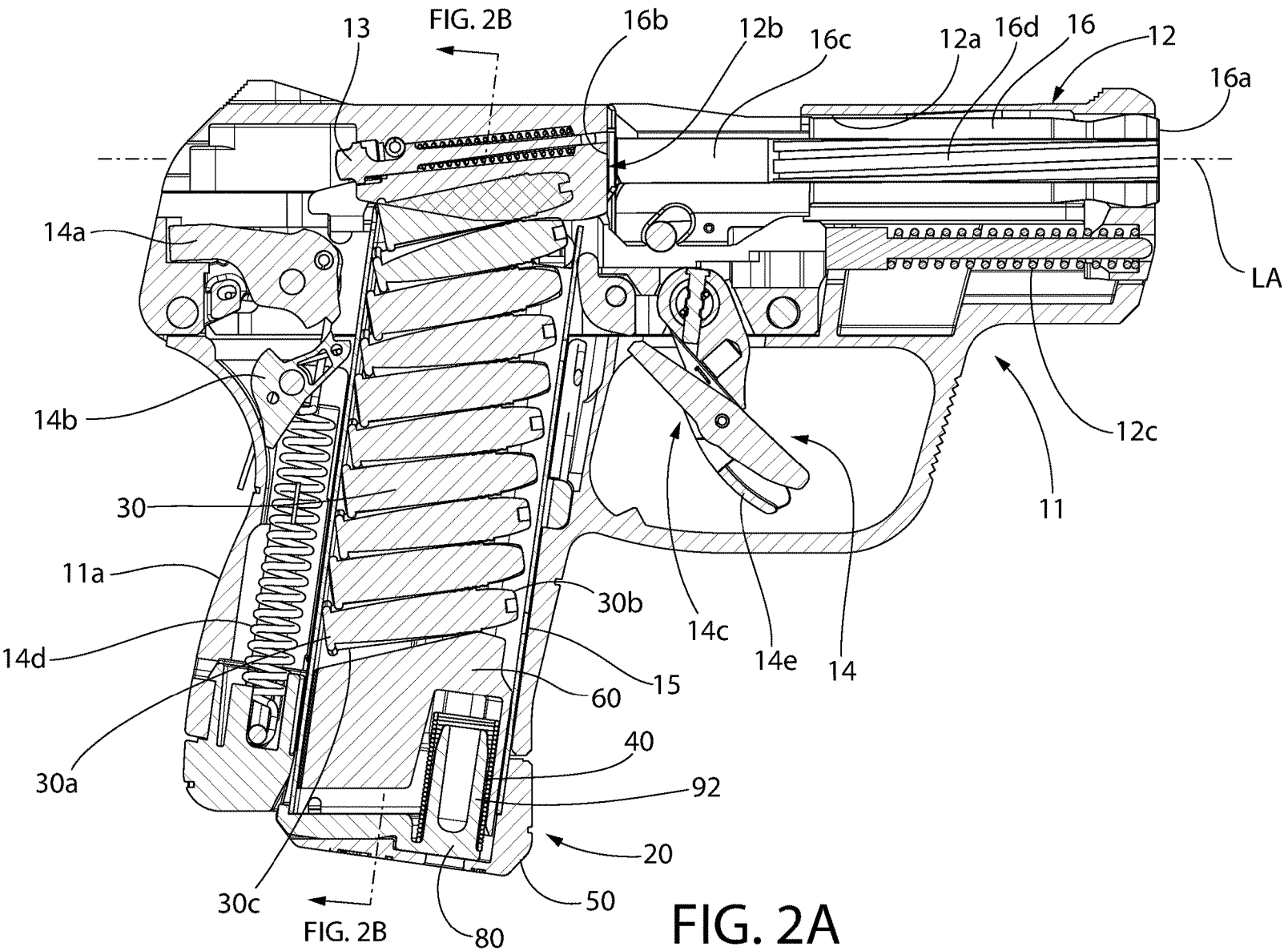
FIG. 2A is a cross-sectional side view thereof.
Figure 2B:
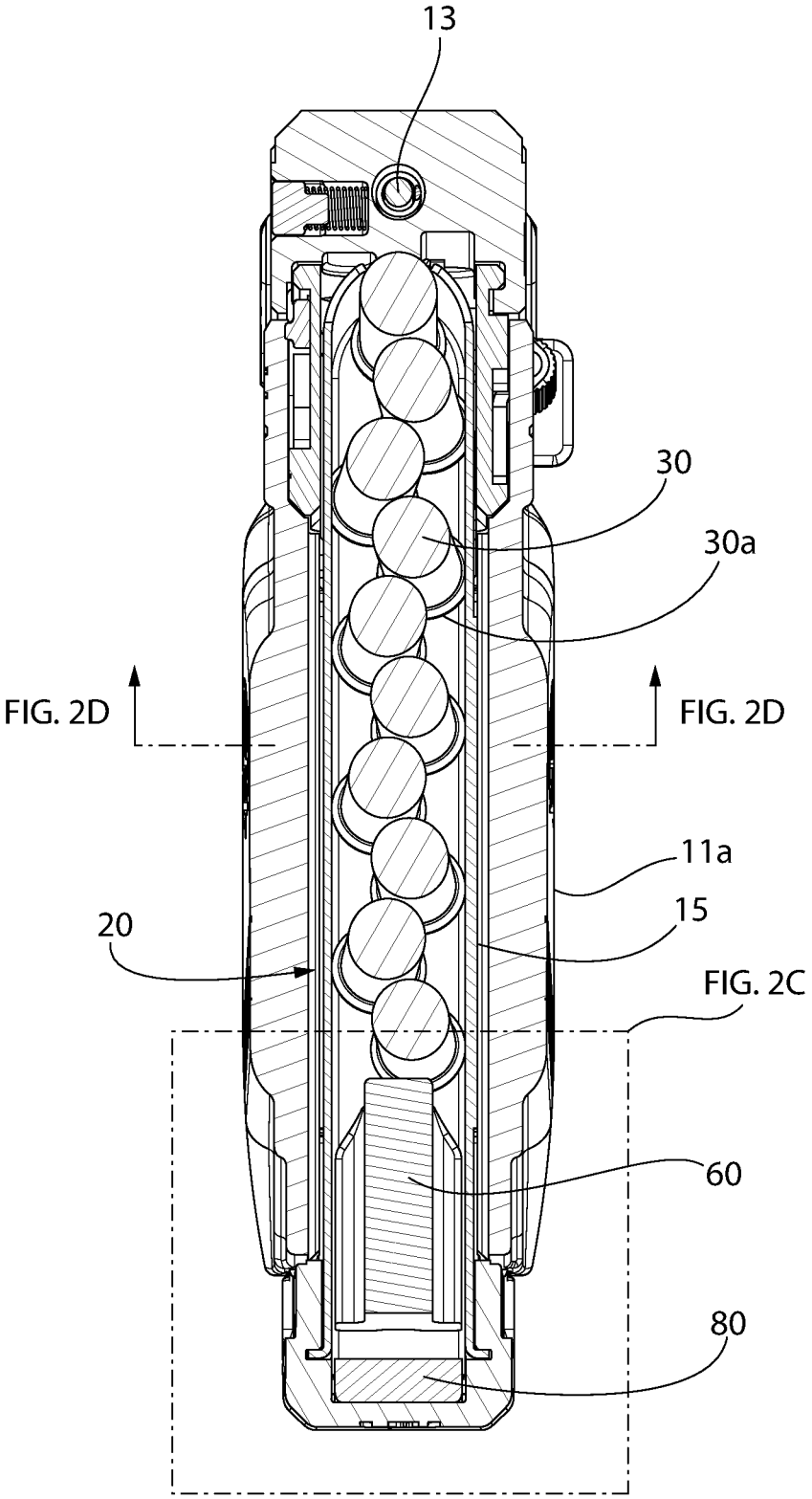
FIG. 2B is a vertical cross-sectional view taken from FIG. 2A looking in the rearward direction.
Figure 2C:
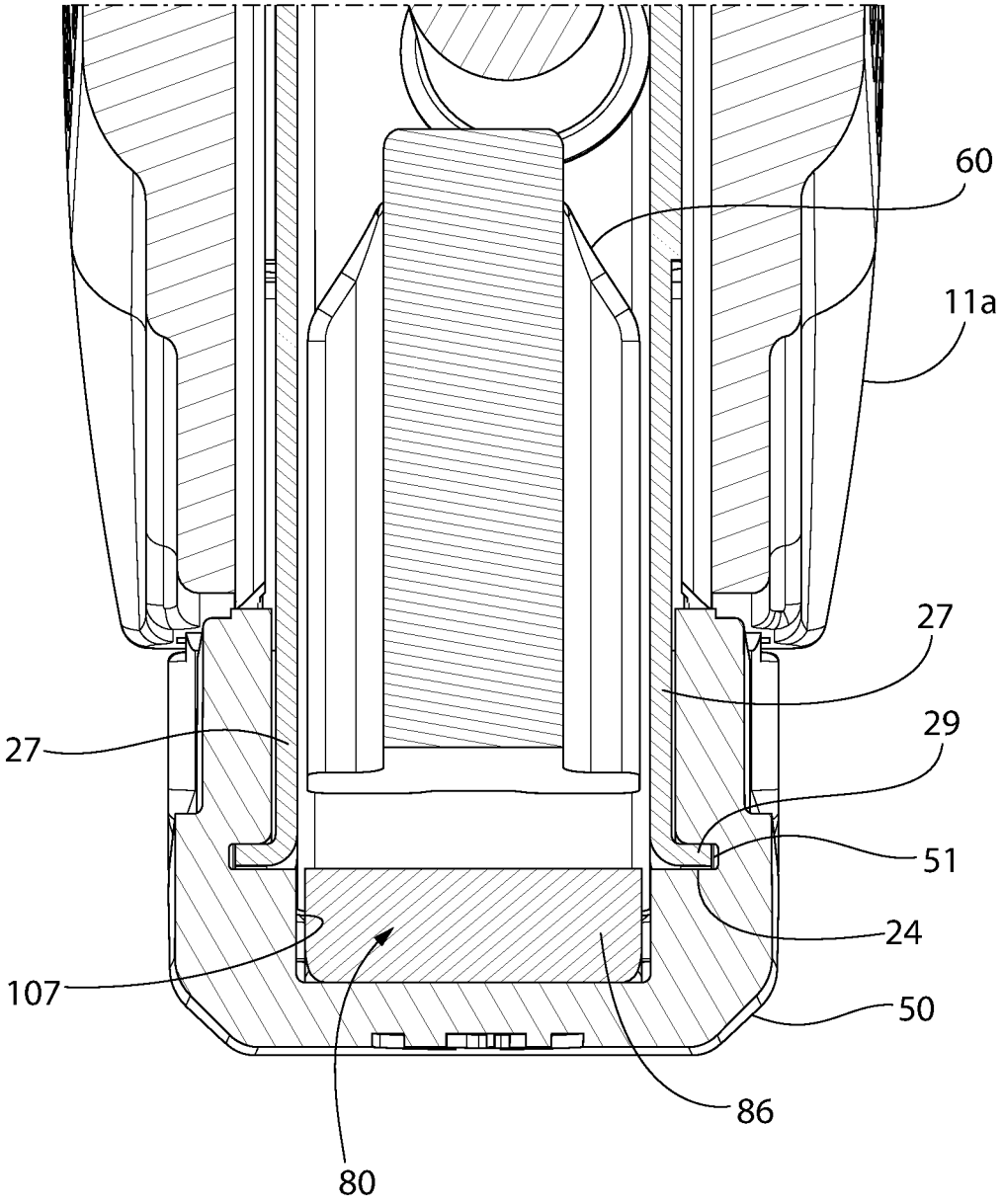
FIG. 2C is an enlarged detail taken from FIG. 2B.
Figure 2D:
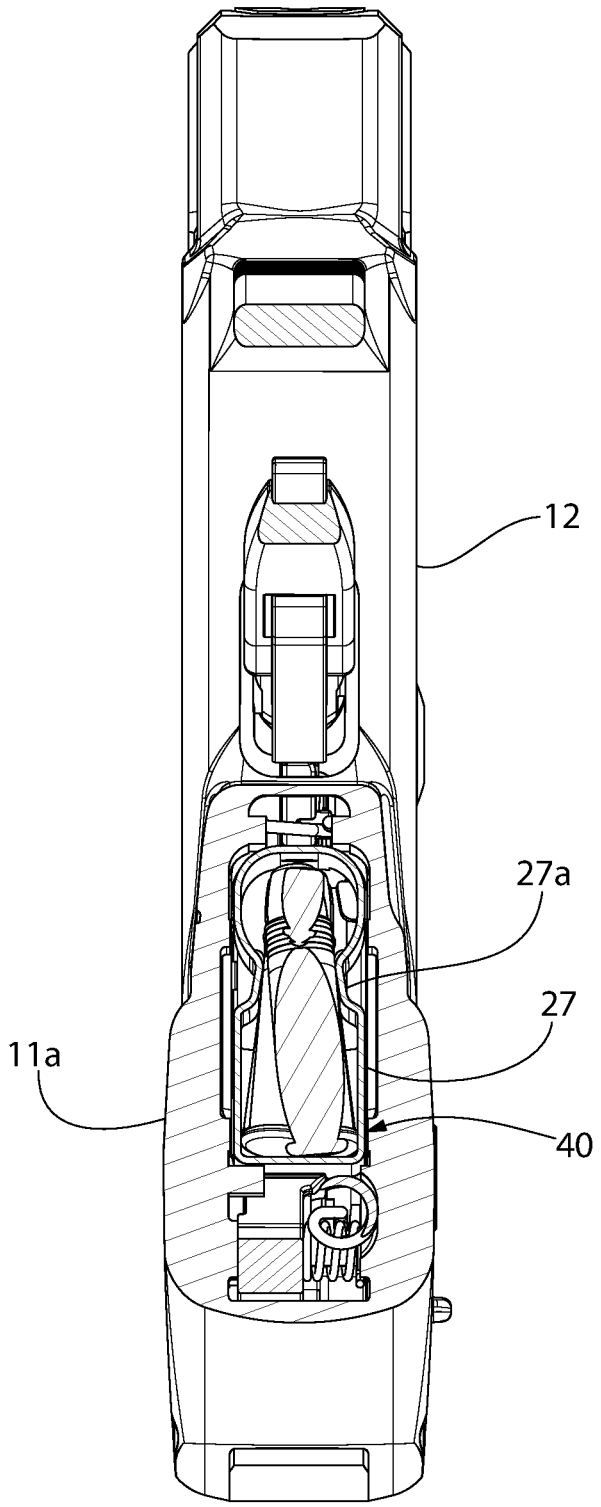
FIG. 2D is a transverse cross sectional view taken from FIG. 2B.
Figure 3:
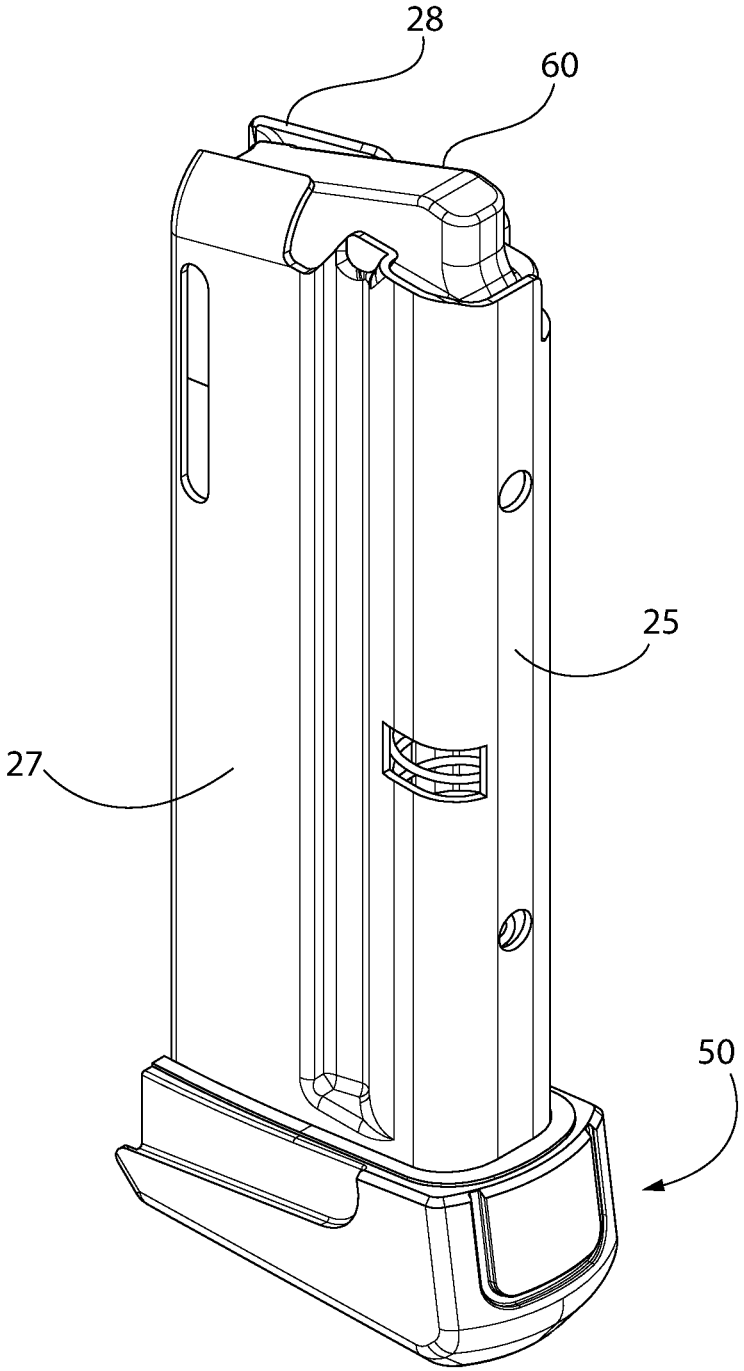
FIG. 3 is a front perspective view of the magazine of FIG. 1.
Figure 4:
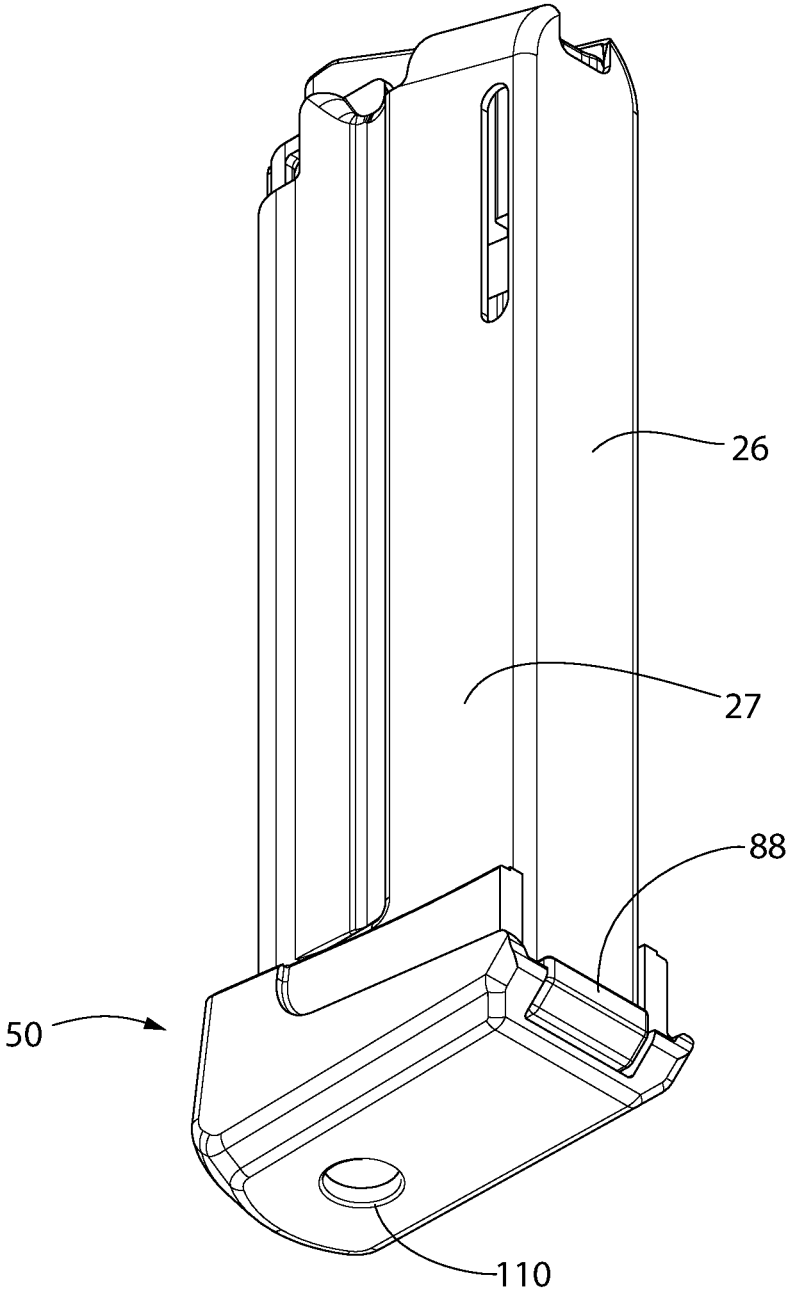
FIG. 4 is a rear perspective view thereof.
Figure 5:
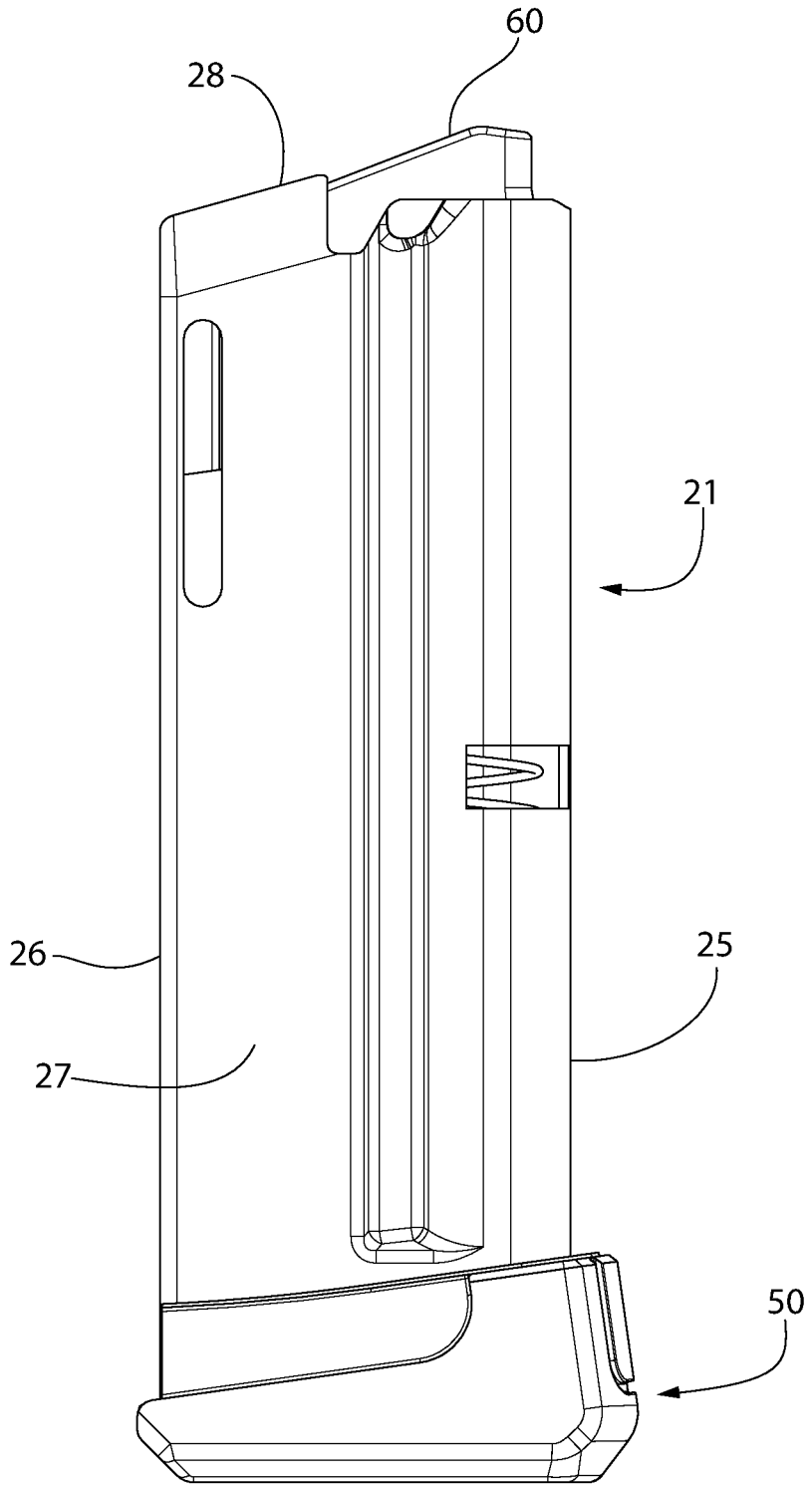
FIG. 5 is a right side view thereof.
Figure 6:
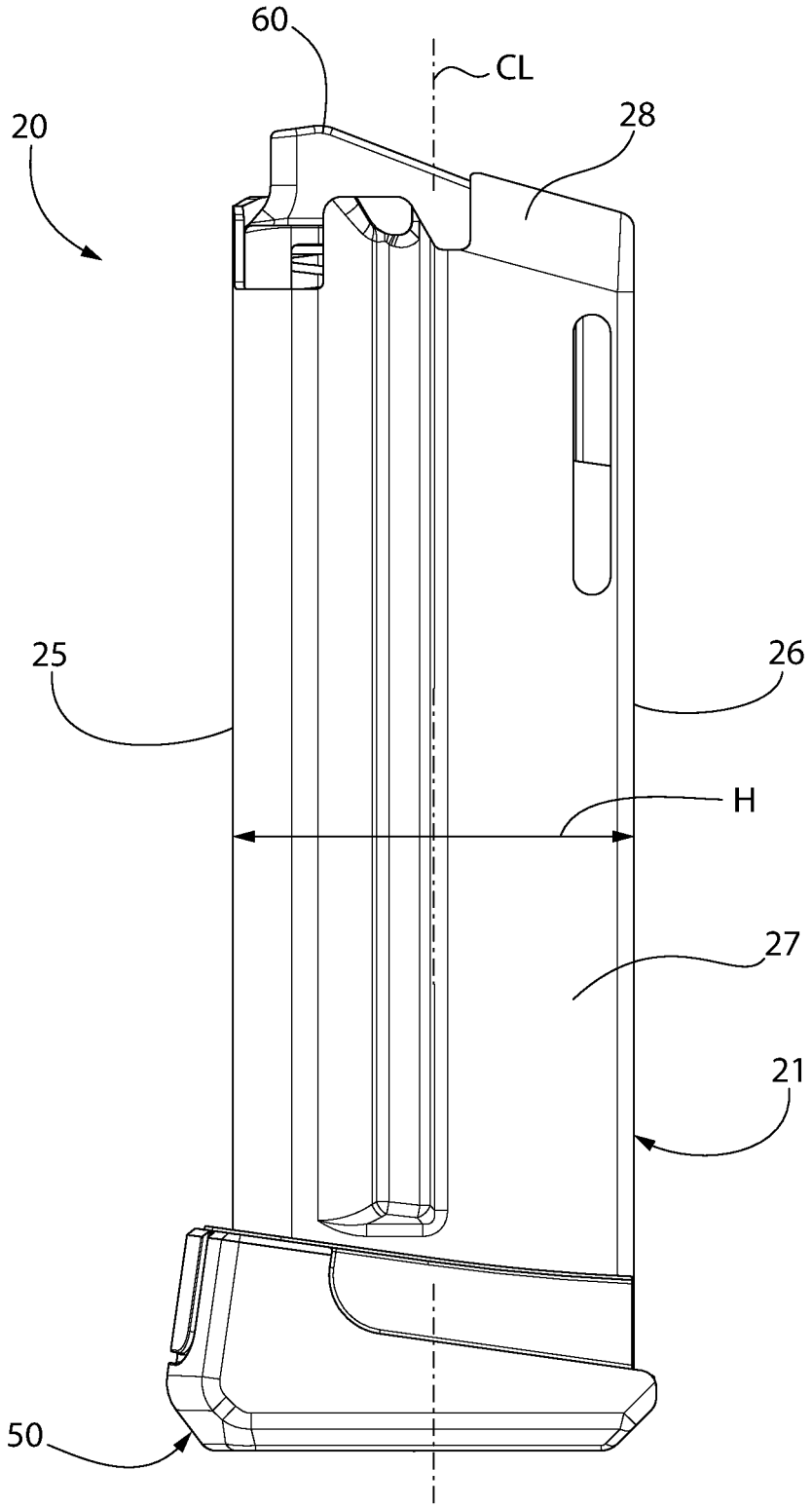
FIG. 6 is a left side view thereof.
Figure 7:
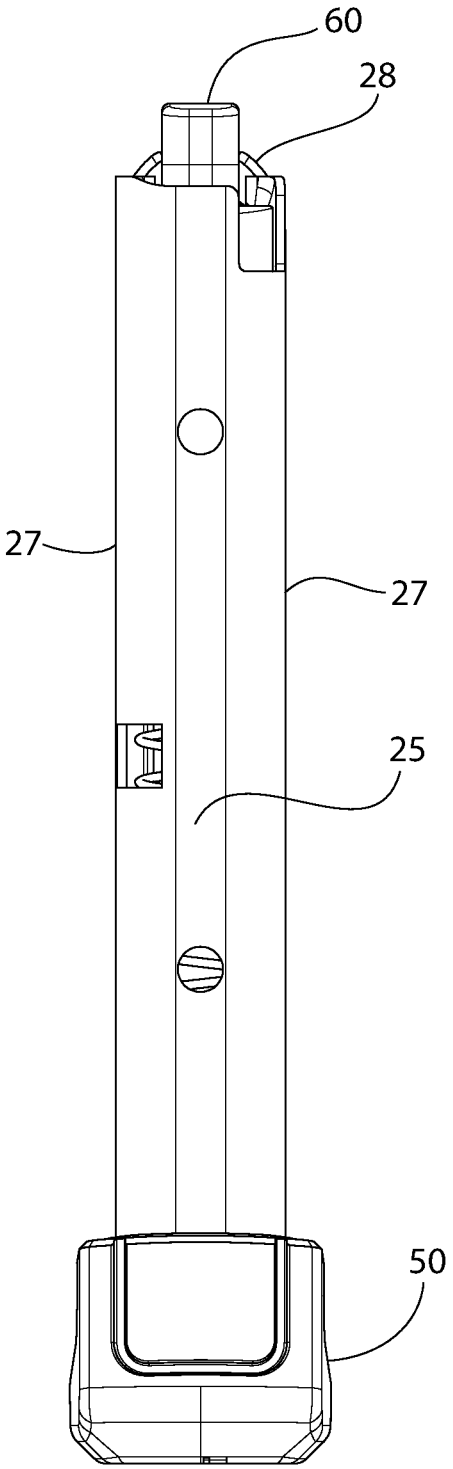
FIG. 7 is a front view thereof.
Figure 8:
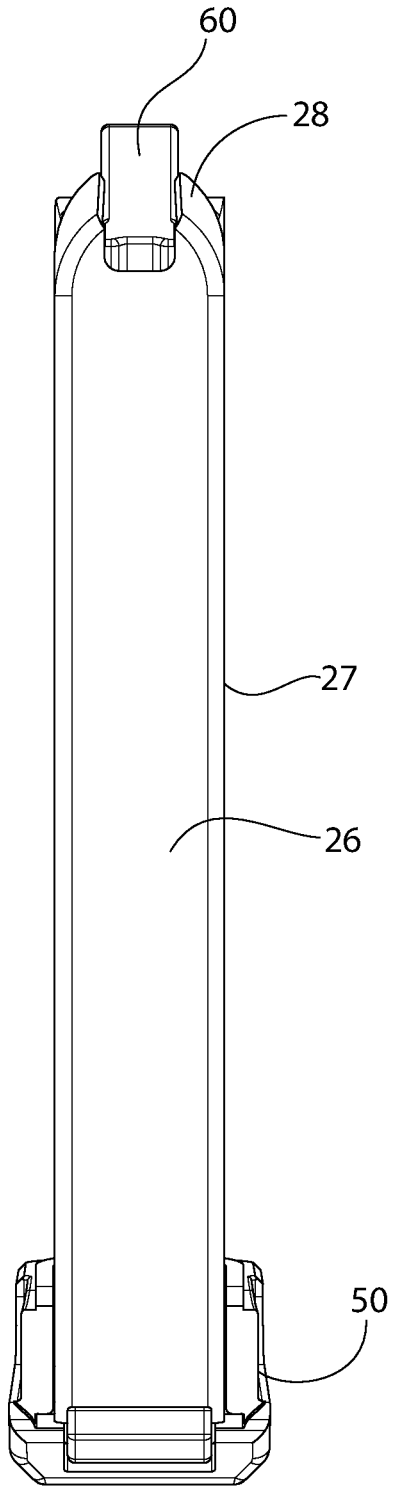
FIG. 8 is a rear view thereof.
Figure 9:
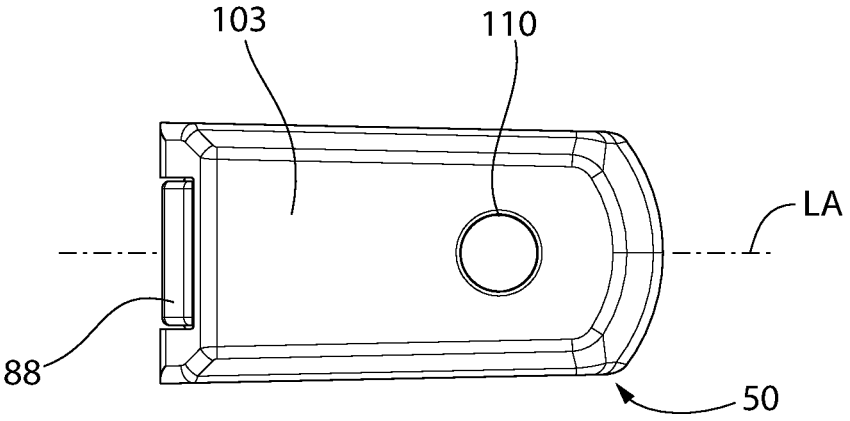
FIG. 9 is a bottom view thereof.
Figure 10:
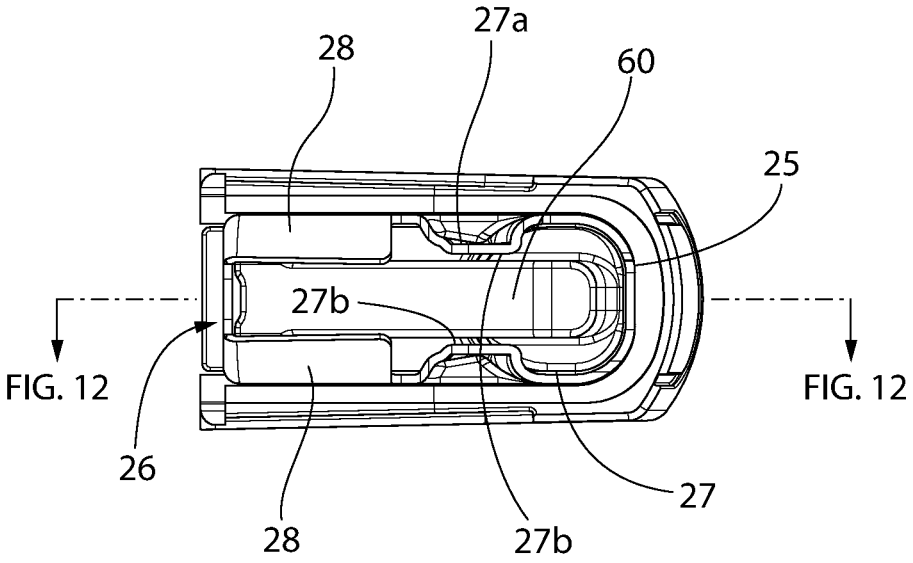
FIG. 10 is a top view thereof.
Figure 11:
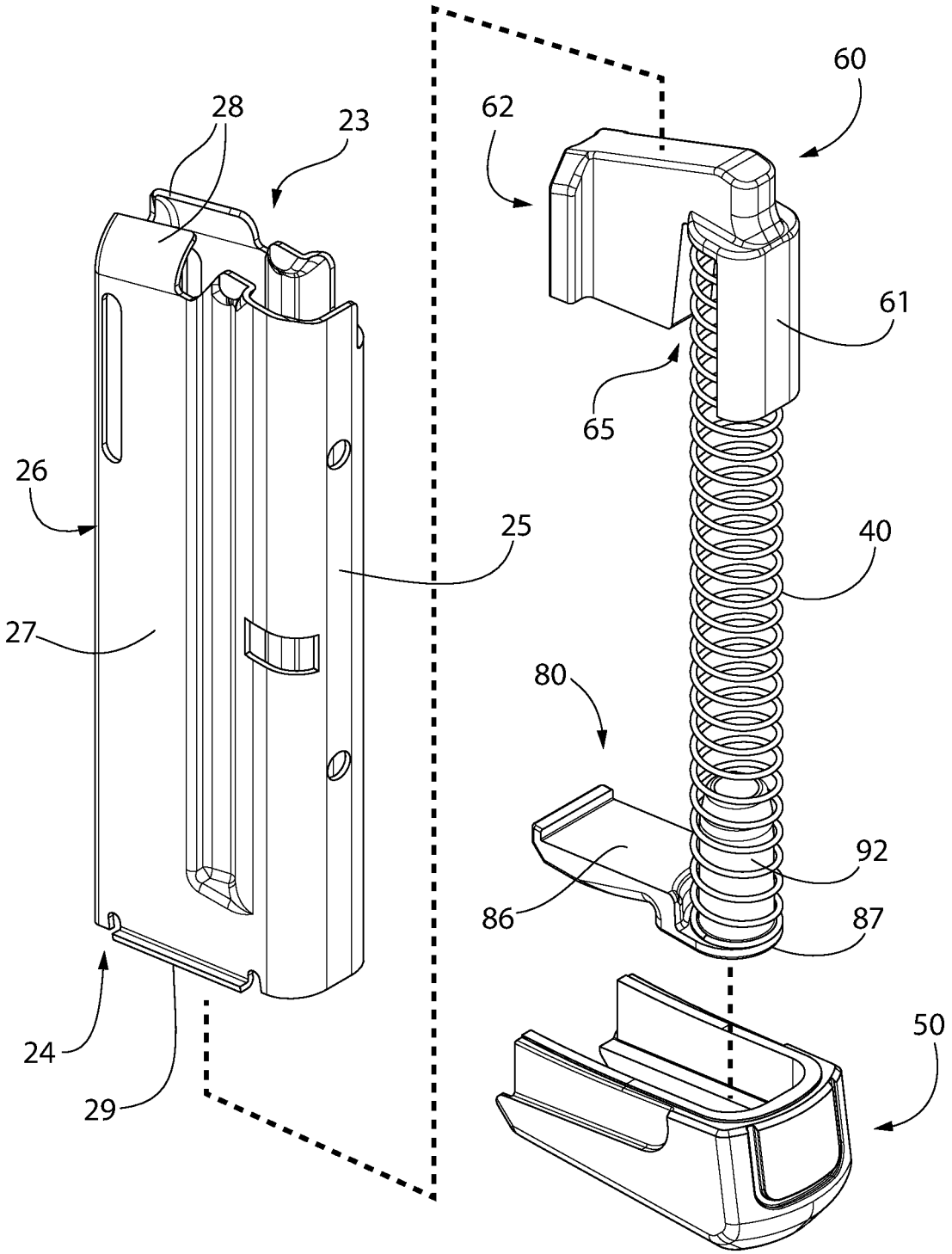
FIG. 11 is a partial exploded view thereof.
Figure 12:
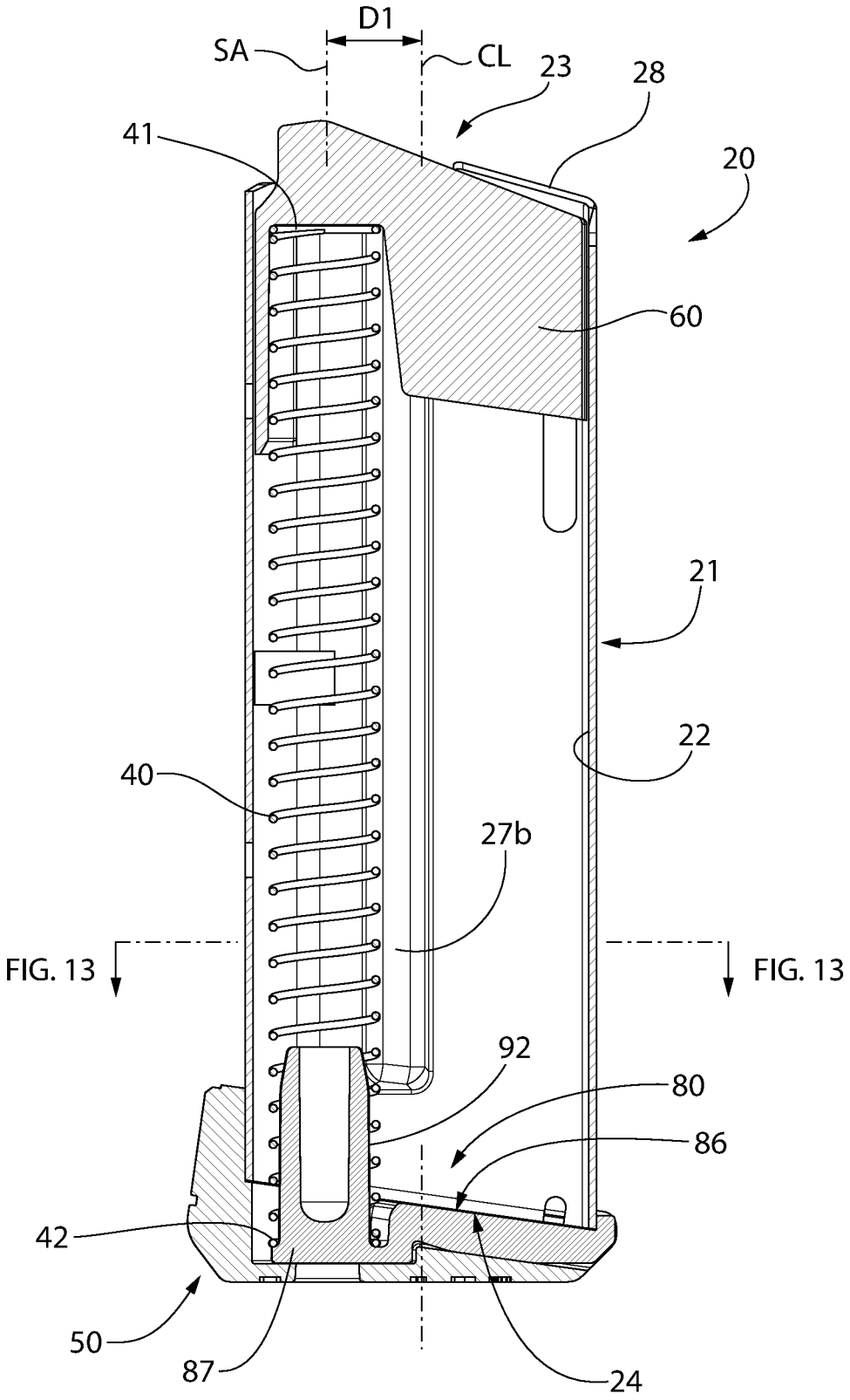
FIG. 12 is a left side cross-sectional view thereof.
Figure 13:
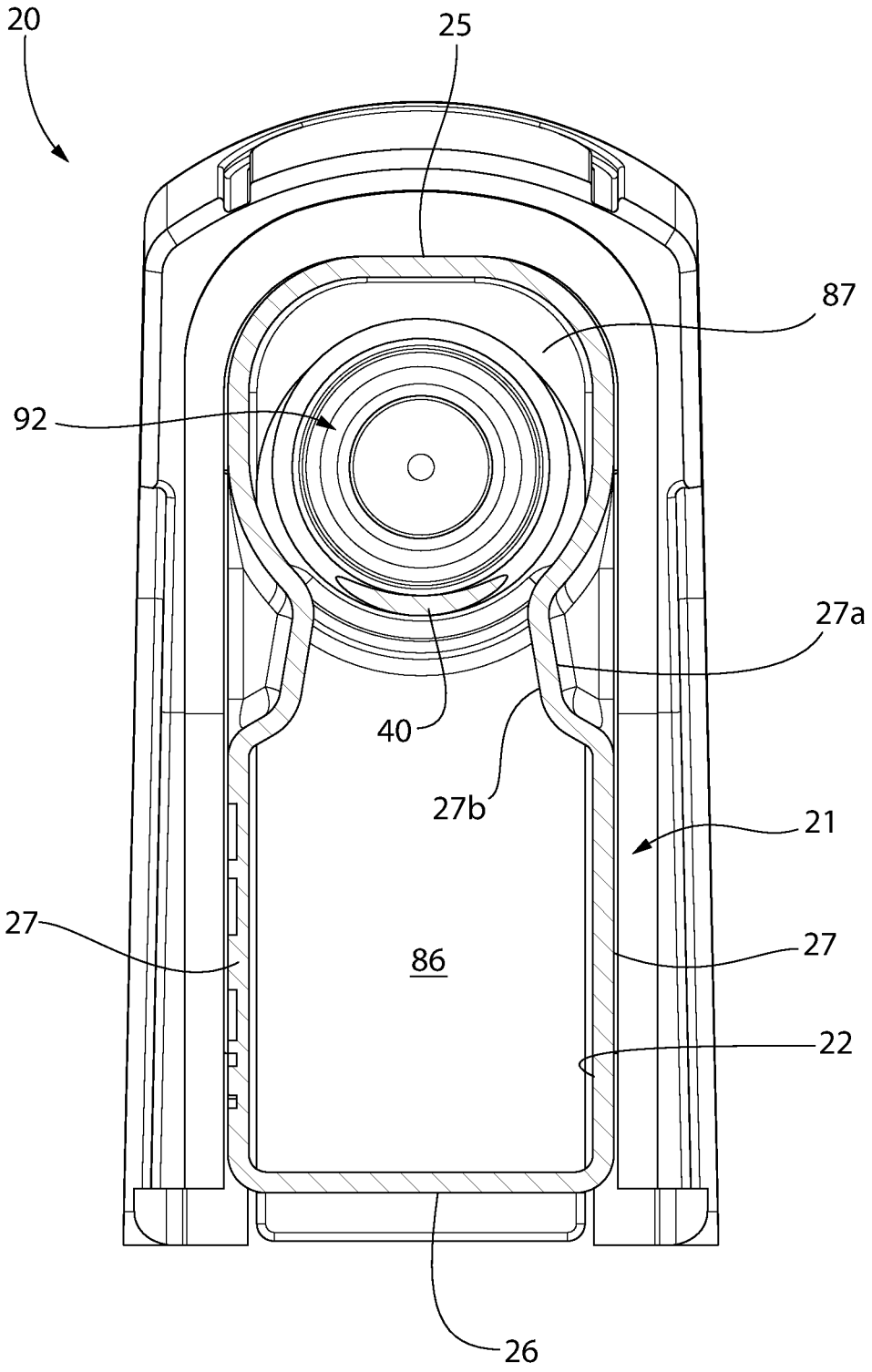
FIG. 13 is transverse cross sectional view thereof taken from FIG. 12.
Figure 14:
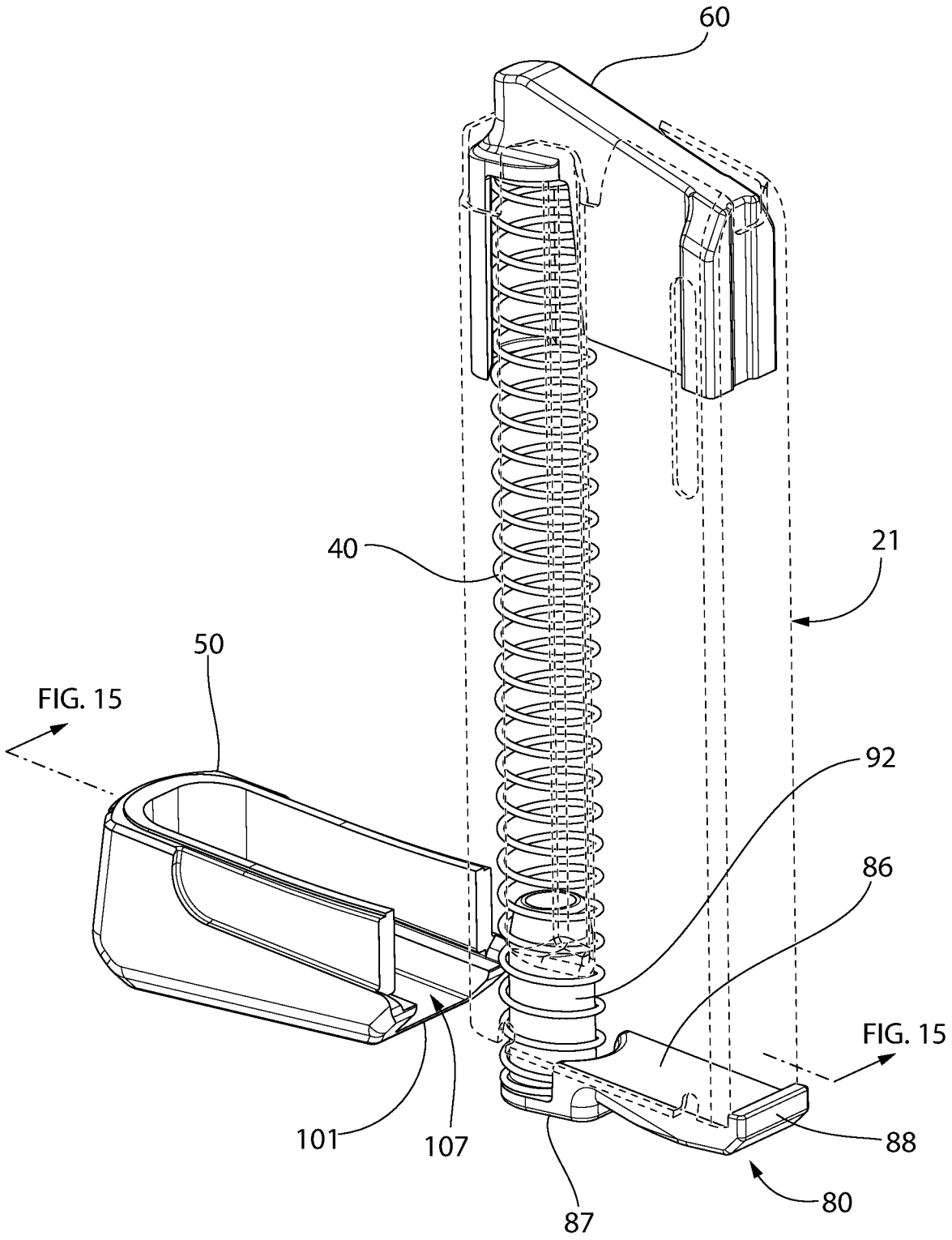
FIG. 14 is an exploded view thereof; showing the magazine before the floor plate is attached.

The tubular body 21 of the magazine 20 (also alternatively referred to herein in places as "tubular magazine body" for short) may have an axially vertically elongated rectangular shape in transverse cross section as seen in FIG. 13. The body 21 defines a vertical centerline CL extending transversely but not necessarily perpendicularly to longitudinal axis LA of the firearm when the magazine is mounted in the firearm 10. As shown in FIG. 2A, the centerline CL may be obliquely oriented to longitudinal axis LA defined by the barrel 16 since the magazine may have an angular position coinciding with the slightly angled orientation of the rear grip portion 11*a* of the frame 11 for firearm gripping ergonomics.

The magazine tubular body comprises a partially open top end 23, open bottom end 24, front wall 25, rear wall 26, and pair of opposing laterally spaced part sidewalls 27 extending therebetween along the longitudinal axis. The walls 25-27 may each include a substantially straight or flat portion in some embodiments as shown which extend vertically along centerline CL. Centerline CL passes through the geometric center of the magazine body defined between the front and rear walls in the horizontal direction and laterally between sidewalls 27. A front-rear/rear-front horizontal direction H (shown in FIG. 6) as may be referred to herein connotes a horizontal direction perpendicular to centerline CL between the front and rear walls 25, 26 of the tubular body.

In the non-limiting illustrated embodiment, each lateral sidewall 27 may include an inwardly concave portion defining a vertically-extending and elongated channel 27*a* in the exterior surface of each magazine side. A pair of laterally opposed channels 27*a* are thus formed. The channels 27*a* concomitantly define a corresponding pair of inwardly projecting cartridge guide protrusions 27*b* which extend vertically along a majority of the height the magazine 20 from top to bottom. The vertically-extending guide protrusions 27*b* may be located more towards the front wall 25 of magazine 20 in the front half rather than towards rear wall 26 of the magazine tube. The protrusions 27*b* form a reduced lateral width which engage the case of the cartridges to keep the cartridge stack from curving under the biasing action of spring 40 due to the differences in diameter between the rear rim of the cartridge and the front of the cartridge near the bullet.

The magazine tube or body 21 may be formed of a suitable preferably lightweight metallic or non-metallic material such as without limitation a metal (e.g. steel or aluminum) or a polymer.

The top end 23 of the magazine is substantially open and includes a pair of inwardly angled or curved cartridge feed lips 28 which engage and retain the uppermost cartridge 30 in the stack. This prevents the column or stack of cartridge from being vertically ejected by the cartridge spring feed mechanism further described herein. In one embodiment, the feed lips 28 are configured and positioned to engage the generally straight portion of cartridge case between the projectile or bullet at front and rear head or base of the cartridge 30 at the primer cap end. Accordingly, the lips 28 may be longitudinally offset towards the rear half of the magazine 20 and may not extend fully in the front to rear direction between front and rear walls 25, 26.

The cartridge 30 may be a centerfire cartridge in some embodiments including the base 30*a* at rear defining an annular extraction rim and a centered primer cap, bullet or projectile 30*b* at front, and the generally straight case 30*c* therebetween (see, e.g. FIG. 2). Other configurations and/or types of cartridges (e.g. rimfire) may be used with magazine 20.

The feed lips 28 are spaced laterally apart and extend axially (i.e. in the general direction of longitudinal axis LA) from a point proximate the rear wall 26 and terminate at a point spaced rearward from the front wall 25 by a sufficient horizontal distance to allow the cartridges to be axially removed from or inserted into the magazine 20 beneath the feed lips. In one embodiment, the feed lips may terminate approximately midway between the front and rear walls of the magazine (see, e.g. FIGS. 5-6 and 10-11).

The magazine 20 is configured for detachable mounting and insertion into a downwardly and upwardly open magazine well 15 defined by the rear grip portion 11*a* of frame 11 from the underside (bottom) of the firearm (see, e.g. FIG. 2). The magazine may be locked into the firearm via a laterally-operated spring-biased latch mechanism 20*a* positioned in the frame of the firearm adjacent the magazine well (FIGS. 1 and 2). The latch mechanism 20*a* locks the magazine in position for use and releases/drops the magazine via operation of the release button of the mechanism for exchanging magazines 20. Such magazine latch mechanisms and their operation are well known in the art without undue elaboration. Examples of various types of latch mechanisms are shown in commonly-owned U.S. Pat. No. 9,194,637, which is incorporated herein by reference in its entirety.

With continuing reference to FIGS. 3-43, magazine 20 further includes an internal cartridge spring feed mechanism. The spring mechanism is generally disposed for the most part in the cavity 22 of the magazine. The feed mechanism may include an axially elongated follower 60, spring 40, and axially elongated spring base 80 which is secured to bottom end 24 of the magazine tube or body 24 by detachable floor plate 50. The spring biases the follower and stack of cartridges supported thereon upwards towards the open top end 23 of the magazine. The top end 41 of spring 40 engages the underside or bottom surface of the follower 60. The bottom end 42 of the spring engages the spring base 80.

In one embodiment, the spring 40 may be a cylindrical helical or coil compression spring with circular shaped coils as shown in the non-limiting illustrated embodiment. The coils may be formed of suitable spring steel wire with circular, square, or rectangular cross-sectional wire profiles. In some embodiments, the spring 40 may be a constant force spring; however, variable force springs may also be used. Spring 40 extends vertically and defines a spring axis SA which may be axially spaced apart and offset from centerline CL of magazine 20 by an axial distance D1 (see, e.g. FIG. 12). Spring 40 may be offset towards and located proximate to front wall 25 of the magazine body 21. Accordingly, the spring may be located directly beneath the open portion of the top end 23 of the magazine forward of the feed lips 28. This offset positioning of spring 40 allows the spring to actively bias the spring follower 60 upwards into a position with the spring force acting directly on the front half or portion of the follower. This ensures positive dispensing and feeding of the cartridges 30 into the breech area of the firearm with the front tip or bullet of the cartridge angled upwards for smooth chambering (see also FIG. 2A).

FIGS. 19-26 are various views depict follower 60 in isolation. The follower 60 has a body that is axially elongated in the direction of the longitudinal axis LA of the magazine 20 when mounted therein. In length, the follower extends axially from the front wall 25 to rear wall 26 of the tubular magazine body 21. Follower 60 includes a front end 61, rear end 62, top 63, bottom 64, and pair of opposed sides 65 extending from front to rear. Top 63 in one embodiment may be defined by a pair of adjoining and angled cartridge feed surfaces 66, 67 each obliquely angled to longitudinal axis LA. Front cartridge feed surface 67 is angled at an acute angle A1 to the rear cartridge feed surface 66 which may be substantially longer in axial length than the rear cartridge feed surface (e.g. 3 time or more in length). Rear cartridge feed surface 66 is obliquely angled to vertical centerline CL of magazine 20 and slopes downward going from front to rear as shown. Front cartridge feed surface 67 is obliquely angled to centerline CL and slopes downwards moving from rear to front. The top surface of follower 60 defined by the front and rear cartridge feed surfaces 67, 66 supports the lowermost cartridge 30 of the cartridge stack in magazine 20.

An apex 68 is formed at the intersection or juncture between the front and rear cartridge feed surfaces 67, 66. Apex 68 has a linear lateral length and defines a pivot point about which the cartridges 30 rotate when fed into the barrel chamber 16*c* by the breech face 12*b* of slide 12 (see, e.g. FIG. 2). When cartridges 30 are dispensed by magazine 20 and uploaded into the breech area, breech face 12*b* of slide 12 being automatically returned forward by recoil spring 12*c* from a rearward position after firing pistol 20 engages the rear base 30*a* of the cartridge which is initially oriented in a tilted manner with its front tip or bullet end angled upwards. As the slide continues to push cartridge 30 forward, the cartridge rotates about apex 68 to change orientation such that the front tip becomes angled downwards which is accommodated by forward and downward sloping front cartridge feed surface 67 to ensure positive entry of the cartridge into the chamber 16*c*. This ensures positive feeding and chambering of the cartridges without jams.

The follower 60 may include anti-tilting and anti-twisting features that guide travel of the follower upwards/downwards in the tubular magazine body 21 to minimize or eliminate tilting or twisting of the follower and potential cartridge feed jams. Follower 60 further includes a pair of laterally protruding guide projections 69 formed at the rear end 62 of the follower on each side. Projections 69 extend in opposite lateral directions beyond the longitudinally-extending reduced width rear portion 70 of the follower. Rear portion 70 may have a solid structure in some embodiments and guide projections 69 may be formed as an integral unitary part thereof as shown. The guide projections slideably engage the interior surfaces of the sidewalls 27 of the tubular magazine body 21 to resist twisting or rotation in a horizontal plane about vertical centerline CL of the magazine and maintain correct axial alignment and orientation of the follower with the longitudinal axis LA of the firearm for smooth operation of the follower. To resist front to rear tilting in a vertical plane, the guide projections 69 and adjoining rear wall of the follower 60 in some embodiments may have a vertical height which is at least 40% or more of the longitudinal length of the follower from front to rear.

The front portion of follower 60 also includes guide features which resist tilting and twisting of the follower as it travels upwards and downwards in the tubular magazine body 21. In one embodiment, these forward features may further include a laterally enlarged guide disk 74 disposed at the front end of the follower 60*a* and a cantilevered front stabilizer projection or wall 72. Stabilizer wall 72 extends downwardly from the horizontally-oriented guide disk 74. Guide disk 74 has a "substantially" circular configuration overall (albeit not perfectly circular as shown) which has a complementary configuration to the front portion of the magazine cavity 22 forward of the vertically-extending cartridge guide protrusions 27*b* on the magazine body 21, previously described herein. The guide disk 74 resists side-to-side twisting of the follower 60 in a horizontal plane about the vertical centerline CL of the magazine as the follower travels up and down in the tubular magazine body 21. The stabilizer wall 72 resists upward and downward tilting of the follower front to rear in a vertical plane to help keep the follower in a horizontal orientation as it travels in the magazine.

Front end 61 of follower 60 further includes a downwardly open spring receptacle 71 configured to receive the top end of magazine spring 40. Receptacle 71 may be defined by an axial gap formed between a front surface 73 of the rear portion 70 of the follower and downwardly extending front stabilizer wall 72 of the follower. Stabilizer wall 72 includes a flat front surface which slideably engages the interior surface of the front wall 25 of the tubular magazine body 21 as the follower moves up when as cartridges are dispensed. Stabilizer wall 72 may project downwards farther than the bottom 64 of follower 60 (see, e.g. FIG. 21). This extended length acts to ensure that the spring 40 (which acts directly on the underside of the follower inside the receptacle) does not tilt the front 61 unduly upwards in a rearward direction, which could otherwise bind movement of the follower resulting in cartridge feed jams.

In some embodiments, the lateral sides of the receptacle 71 may be open to reduce weight (shown). In other implementations, the receptacle may be completely enclosed at the front, rear, and both sides by extending the stabilizer wall rearward on both sides until these extensions each meet the rear portion 70 of follower 60 at opposite sides. In some embodiments, the interior surface 72*a* of the stabilizer wall 72 may be arcuately curved to generally complement the circular coils of spring 40.

Follower 60 may have a monolithic unitary structure in some embodiments in which all of the foregoing features described are integral parts thereof. Follower 60 may be formed of any suitable non-metallic or metallic material for the application. In one embodiment, the follower may be formed of injection molded plastic.

FIGS. 27-34 are various views depicting spring base 80 in greater detail. The spring base has a body that is axially elongated in the direction of the longitudinal axis LA of the magazine 20 when mounted thereon. In length, spring base 80 extends from rear wall 26 of the tubular magazine body 21 to a point spaced apart rearwards from the front wall 25 of the magazine body (see also FIG. 18). Accordingly, the front end of the spring base does not contact the front wall 25 or bottom edge thereof of the magazine body 21 in the non-limiting illustrated embodiment.

Figure 33:
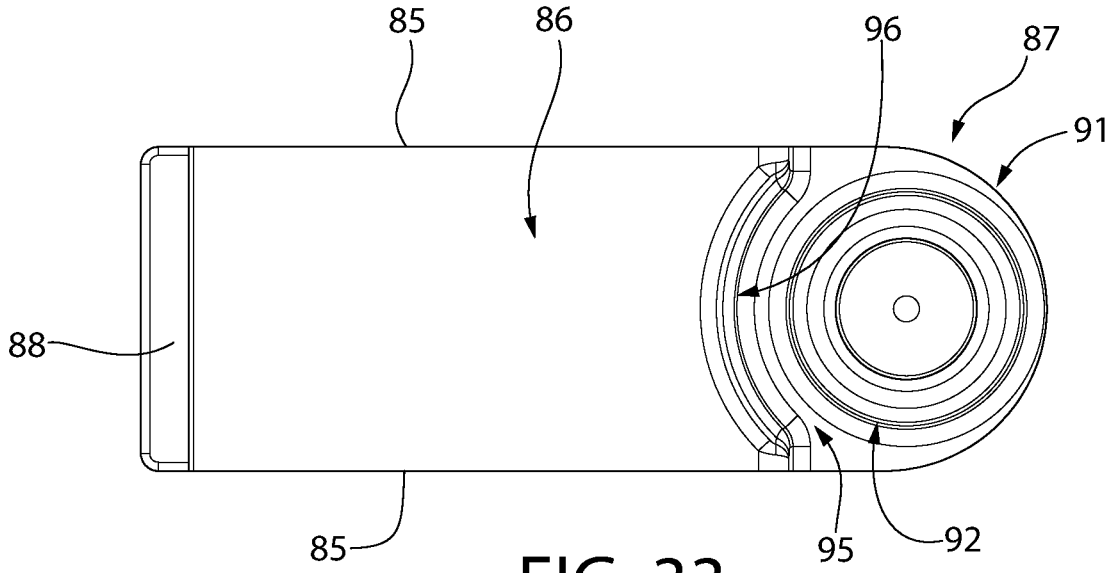
FIG. 33 is a top view thereof.
Figure 34:
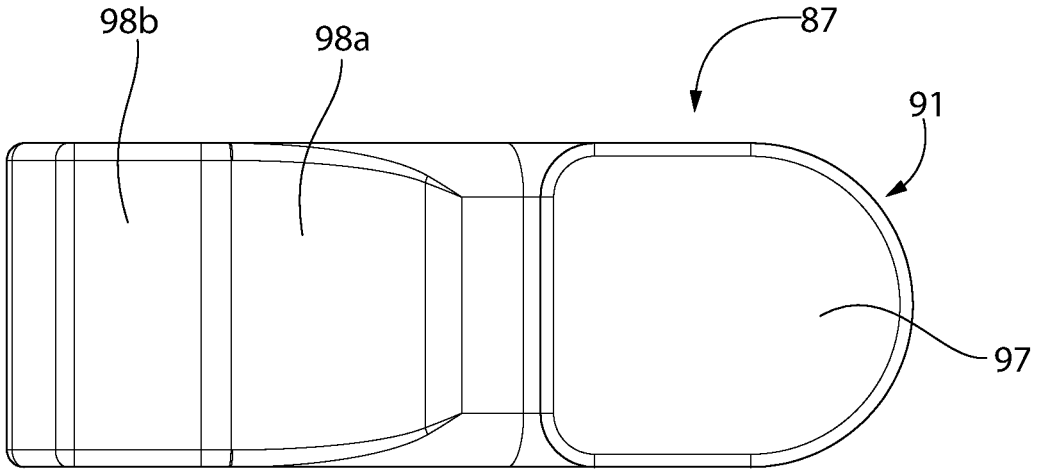
FIG. 34 is a bottom view thereof.
Figure 35:
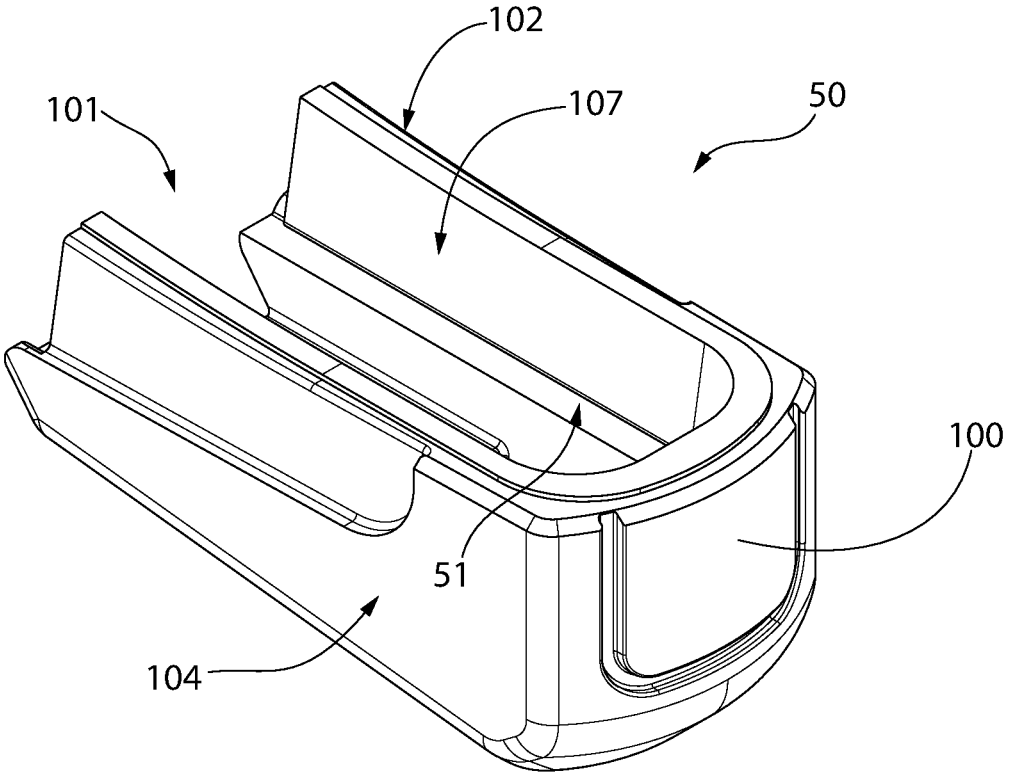
FIG. 35 is a front perspective view of the floor plate of the magazine.
Figure 36:
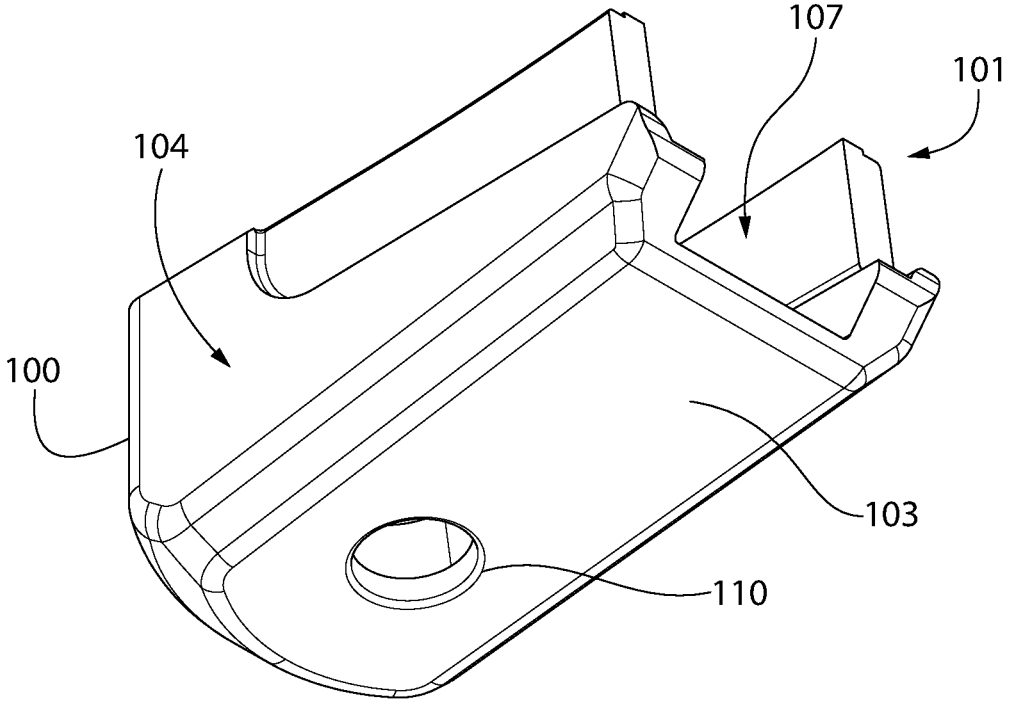
FIG. 36 is a bottom rear perspective view thereof.
Figure 37:
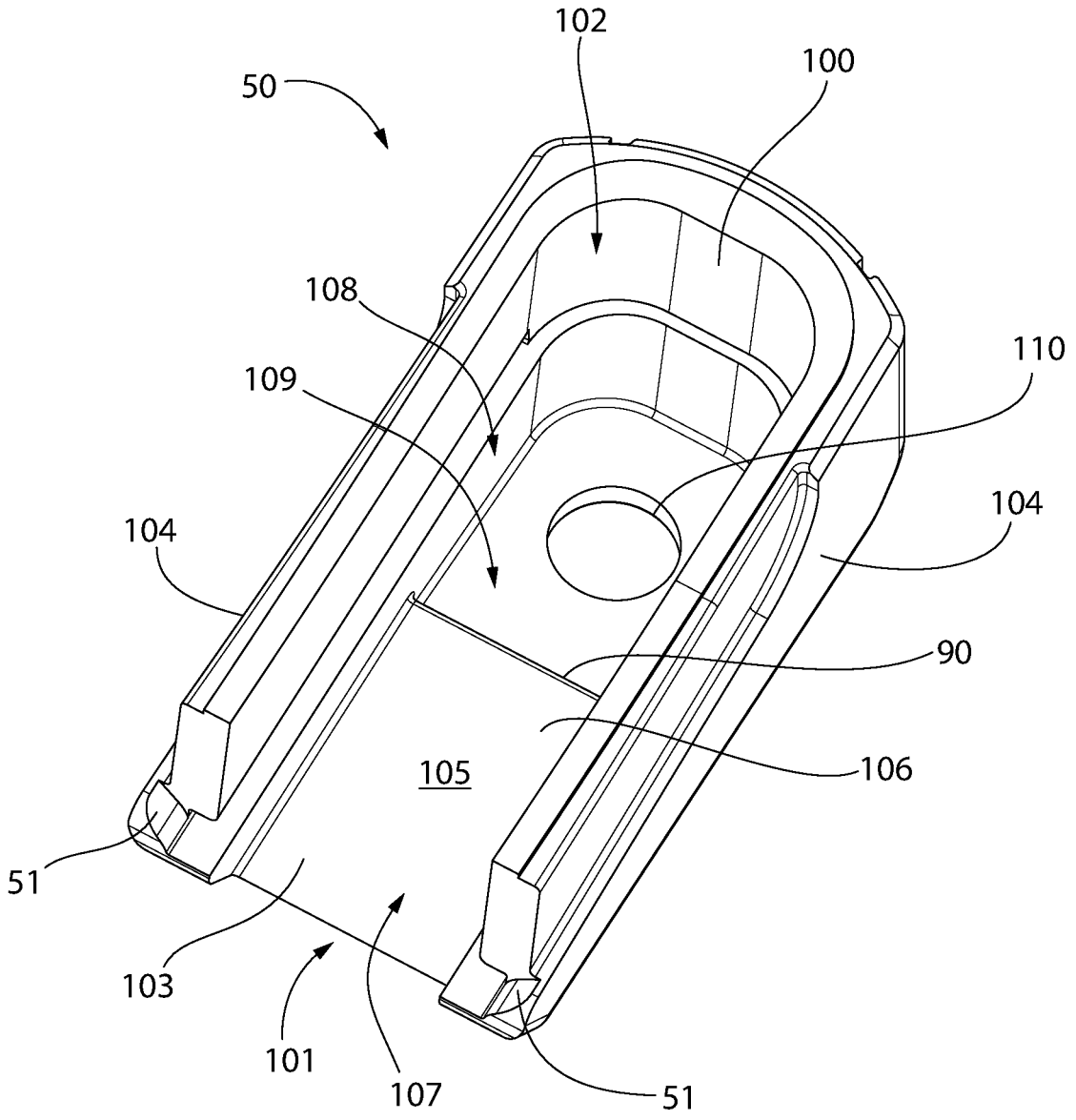
FIG. 37 is a top rear perspective view thereof.
Figure 38:
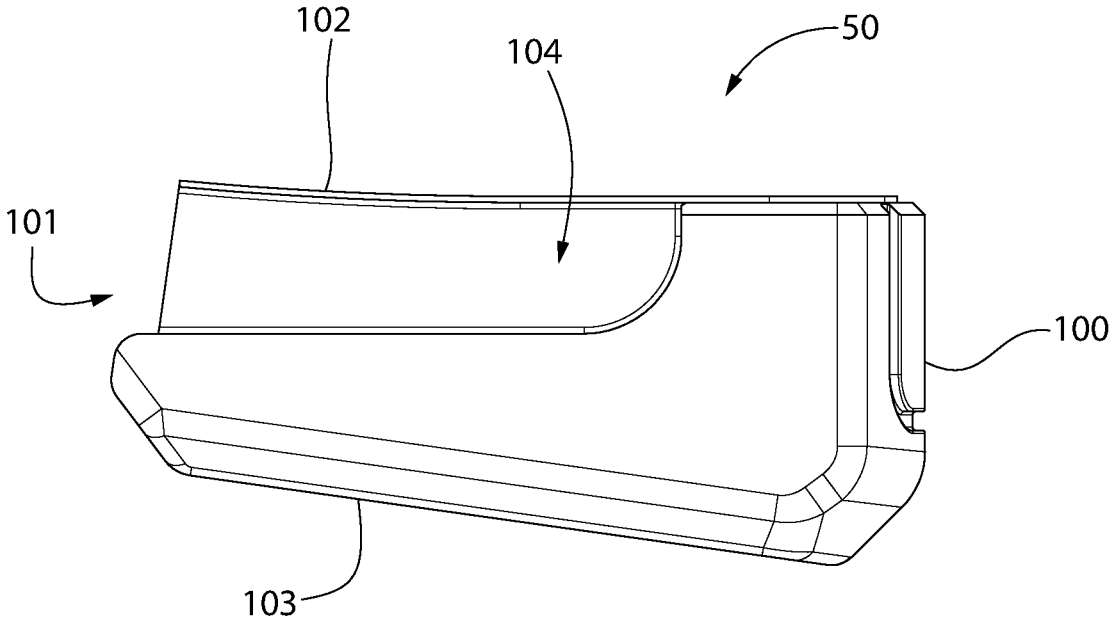
FIG. 38 is a right side view thereof.
Figure 39:
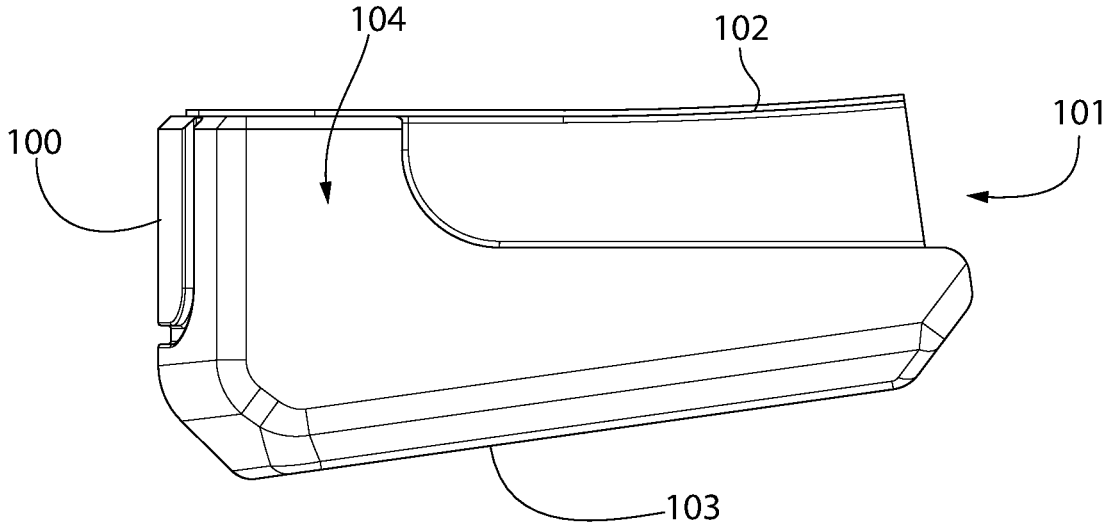
FIG. 39 is a left side view thereof.
Figure 40:
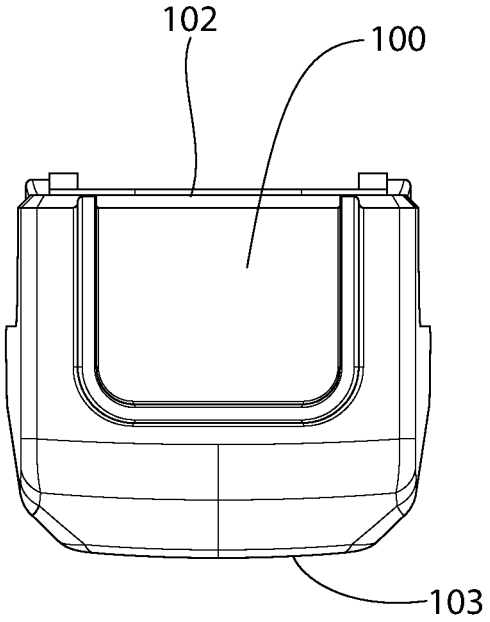
FIG. 40 is a front rear view thereof.
Figure 41:
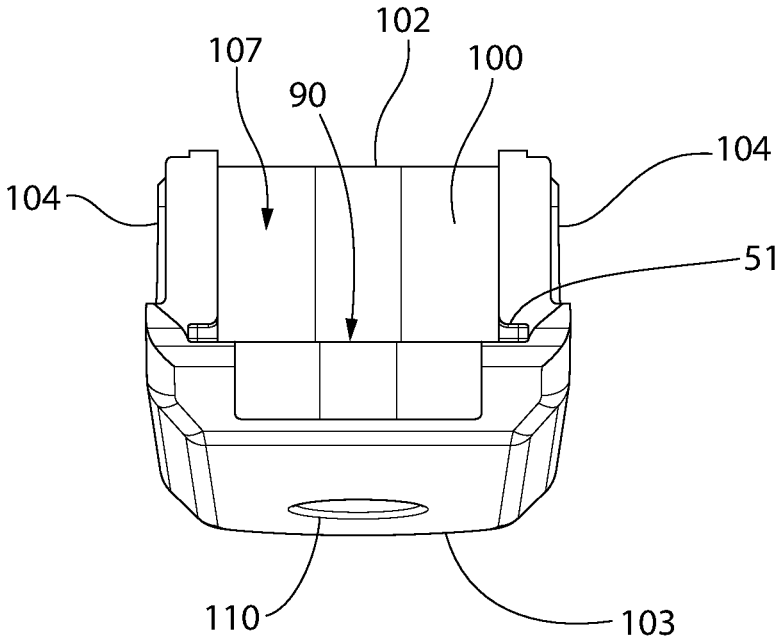
FIG. 41 is a rear view thereof.
Figure 42:
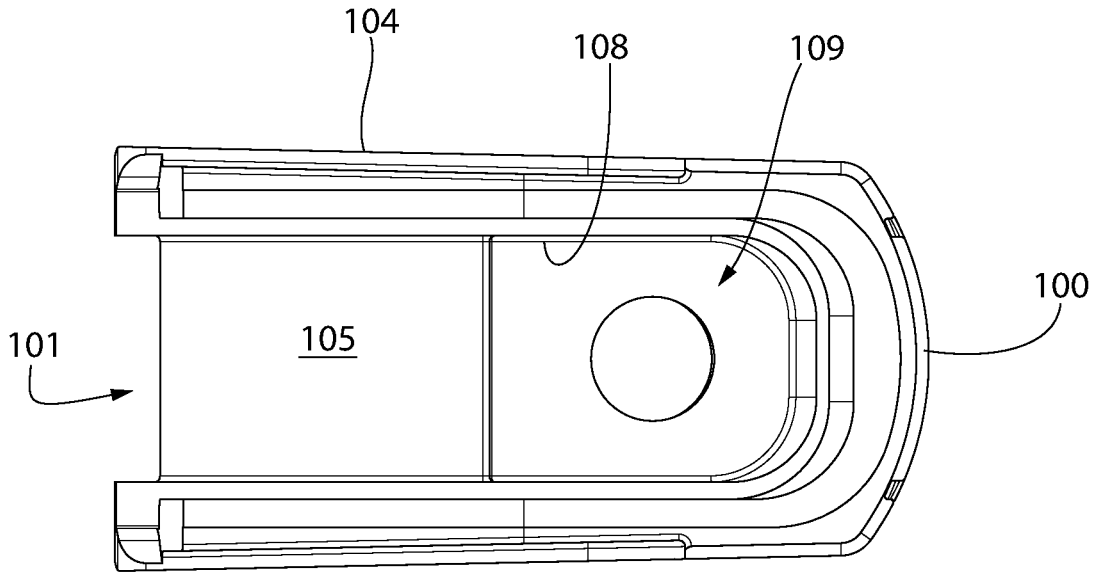
FIG. 42 is a top view thereof.
Figure 43:
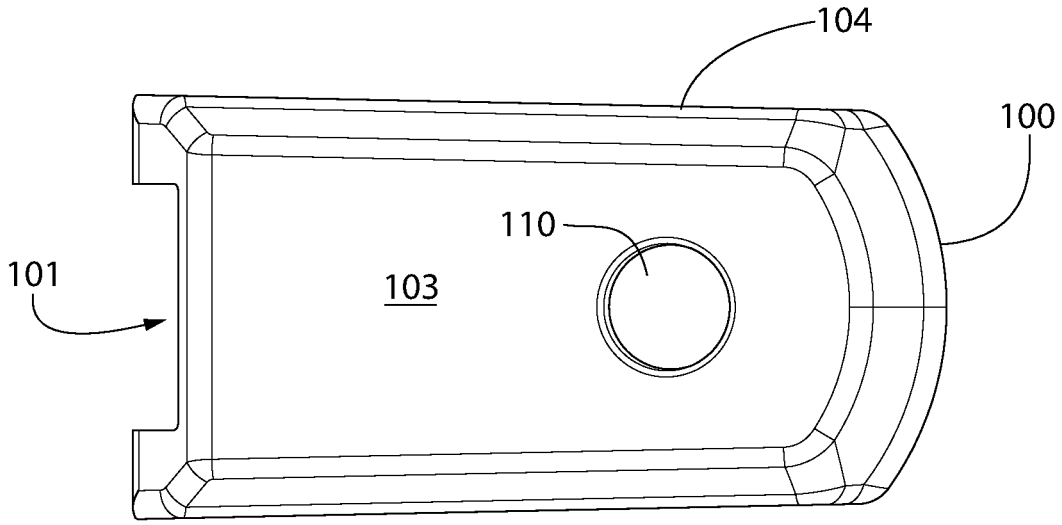
FIG. 43 is a bottom view thereof.

With additional reference to FIGS. 15-18, spring base 80 includes a front end 81, rear end 82, top 83, bottom 84, and pair of opposed sides 85 extending from front to rear. The spring base may have a main body comprised of an axially elongated rear portion 86 and a cantilevered spring arm 87, which may extend forwardly from the rear portion. Spring arm 87 may have a semi-circular shape in top plan view (i.e. looking downwards thereon as shown in FIG. 33) to complement the circular coils of spring 40. Accordingly, spring arm 87 defines an upward facing circular annular spring seating surface 92*a* which engages and supports the bottom coil of spring 40. The seating surface 92*a* surrounds the circumference of the spring retention protrusion 92. Rear portion 86 may have a generally rectangular shape in top plan view and may be longer in longitudinal length than the spring arm 87. Each may have approximately the same maximum lateral width in certain embodiments. Both the rear portion 86 of the spring base body and the cantilevered spring arm 87 may have a width smaller than the interior lateral width of the tubular magazine body 21 such that the rear portion and spring arm can enter the open bottom end of the body when the spring arm moves from the lower undeflected position to the upper deflected position about pivot axis PA formed at the rear end of the rear portion by raised lip 88 (see, e.g. FIGS. 17-18).

An inclined top surface 93 is defined by the rear portion 86 which has an angle which matches the angle formed by the bottom edges of the magazine body sidewalls 27 that slope downward from front to rear; the rear wall 26 of the tubular magazine body 21 having a greater height than front wall 25 such the rear wall bottom edge may be lower than the front wall bottom edge, in one embodiment as shown. Raised lip 88 is formed at the rear end of the spring base which protrudes upwardly from rear portion 86. Lip 88 is arranged to engage the bottom edge of the magazine body rear wall 26 which sets the desired axial/longitudinal position of the spring base on the magazine, and forms part of an interlock feature which retains the floor plate 50 on the magazine tube as further described herein.

Spring base 80 may have a stepped configuration is side profile such that spring arm 81 (i.e. arcuately curved semi-circular base portion 91) is vertically offset and positioned below at least the forward-most the top surface 87 of rear portion 86. A stepped transition is formed between spring arm 87 and rear portion 86 on the underside of the spring base which defines a first locking feature in the form of a recessed V-shaped locking notch 89. Locking notch 89 receives and engages a corresponding second locking feature such as a V-shaped locking edge 90 formed on a stepped lower portion of the floor plate 50 when the floor plate is slideably and fully mounted on the bottom end of the tubular magazine body 21 (see, e.g. FIG. 18). Locking engagement between the locking notch and edge prevent the floor plate 50 from being removed from the magazine body 21 in the forward axial direction to keep the spring base and floor plate assembly together without the use of fasteners, as further described herein.

The bottom surface 97 of spring arm 87 may be straight and flat being oriented perpendicularly to vertical centerline CL of magazine 20. In one embodiment, bottom surface 97 may lie in the same horizontal plane as a straight flat surface section 98*b* of the bottom surface 98 of the spring arm rear portion 86. Bottom surface 98 of the spring base rear portion 86 may also include a flat front sloped surface section 98*a* (oriented obliquely to centerline CL) which has an angle that matches a top sloped surface 106 of an inclined ramp 105 of floor plate 50 as further described herein (see, e.g. FIGS. 15-18). This forms a flat-to-flat interface between sloped surface section 98*a* of the rear portion 86 of spring base 80 and the top sloped surface 106 of the inclined ramp 105 for stability of the assemblage and a snug fit (best shown in FIG. 18).

Spring arm 87 further includes an upstanding spring retention protrusion 92 in one embodiment. Protrusion 92 extends upwards from and perpendicular to semi-circular base portion 91 of the spring arm which may be integrally formed with the front end of the elongated rear portion 86 of the spring base 80. Base portion 91 engages and supports the bottom coil of magazine spring 40 which is seated thereon. In one embodiment, retention protrusion 92 may be spaced apart forwardly from vertical front wall 96 of the rear portion 86 forming an upwardly open gap or recess which receives the lower coils of spring 40 therein (see, e.g. FIGS. 18 and 33). Front wall 96 may be arcuately curved to complement the circular shape of the spring coils.

Figure 30:
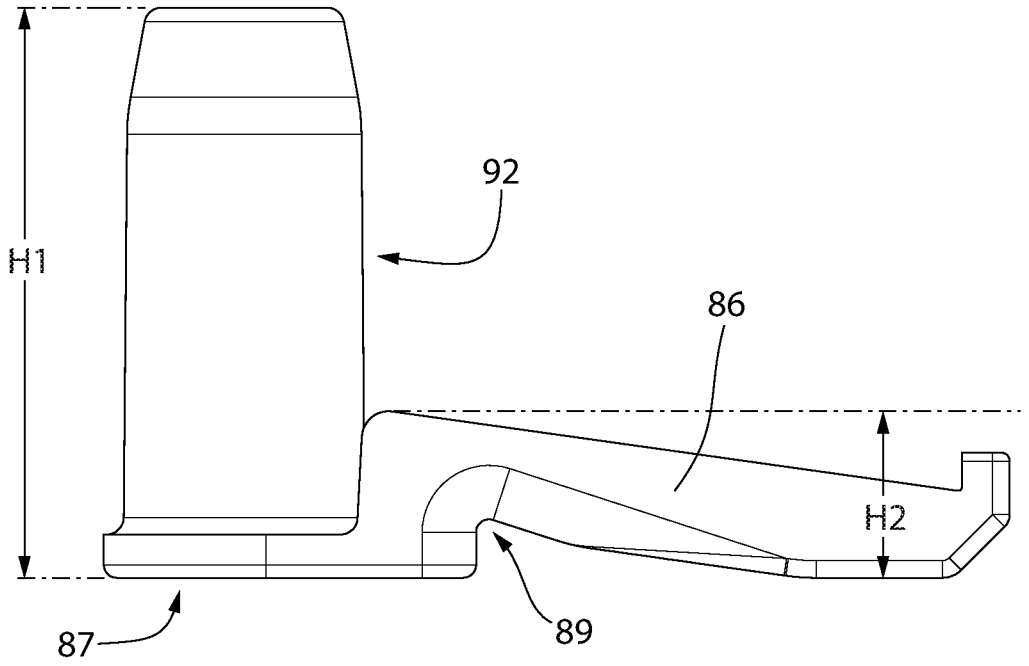
FIG. 30 is a left side view thereof.
Figure 32:
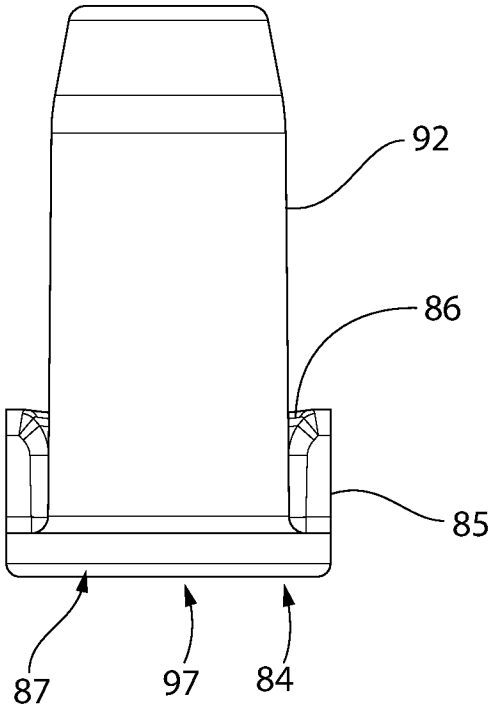
FIG. 32 is a front view thereof.
Figure 31:
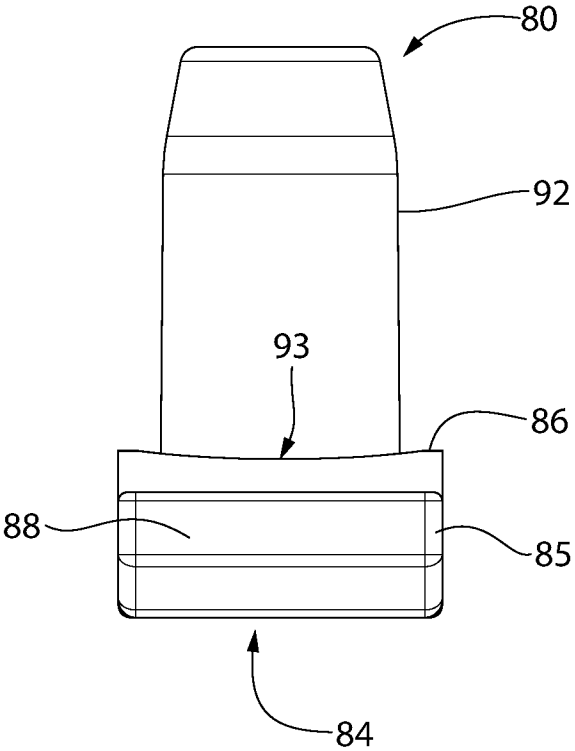
FIG. 31 is a rear view thereof.

Protrusion 92 has a height H1 which extends substantially above the top surface 93 of the rear portion 86 (e.g. at least twice the height H2 of the rear portion in certain non-limiting embodiments) as shown in FIG. 30. Spring retention protrusion 92 may have a cylindrical shape in one and is configured to further engage and support the lowermost coils of spring 40 (see, e.g. FIGS. 12 and 18). The height H1 of protrusion 92 helps prevent the spring from unduly deforming in the front to rearward and lateral directions (transverse and perpendicular to magazine centerline CL) as the spring is compressed when loading cartridges 30 into magazine 20. To facilitate installing the spring on spring retention protrusion 92, the protrusion may have a frusto-conical shaped top end as shown in some embodiments. Other shapes of protrusions 92 rather than cylindrical may be used which are capable of supporting and retaining the bottom end of spring 40, such as without limitation angular faceted sides resulting in hexagonal and octagonal cross-sectional shapes rather than a circular cross-sectional shape corresponding to the non-limiting cylindrical configuration disclosed herein.

Spring base 80 may have a monolithic unitary structure in some embodiments in which all of the foregoing features described are integral parts thereof. The spring base may be formed of any suitable non-metallic or metallic material for the application. In one embodiment, the spring base 80 may be formed of injection molded plastic.

FIGS. 35-41 are various views depicting floor plate 50 in greater detail. The floor plate has a body that is axially elongated in the direction of the longitudinal axis LA of the magazine 20 when mounted thereon. In length, floor plate 50 extends from rear wall 26 of the tubular magazine body 21 to a point beyond and spaced apart from the front wall 25 of the magazine body resulting in a forward projection therefrom (see also FIG. 18).

With additional reference to FIGS. 15-18, floor plate 50 includes a front wall 100, open rear end 101, open top 102, bottom wall 103, and pair of opposed sidewalls 104 extending from front to rear and projecting upwards from bottom wall 103. Front wall may be arcuately curved from side to side in one embodiment as shown (see, e.g. FIGS. 42-43). The walls define an upwardly and rearwardly open channel 107 which extends in the horizontal direction H from front wall 100 to rear end 101. Channel 107 is configured to receive the bottom end 24 of the tubular magazine body 21 when the floor plate is mounted thereon, as further described herein. Elongated lateral mounting grooves 51 formed on the interior surfaces of each sidewall 104 on opposite sides of channel 107. Mounting grooves 51 extend horizontally for a majority of the length of the channel 107. Lateral grooves 51 are elongated linear structures which open rearwardly and slideably receive corresponding lateral flanges 29 on the bottom end of the magazine tubular body 21 in the sides of the floor plate 50. When the grooves and flanges are mutually engaged, the floor plate 50 is locked vertically on the tubular body 21 such that the floor plate cannot be vertically removed from the magazine (in a direction parallel to centerline CL). The front ends of each groove 51 may be closed which served as travel stops to limit the horizontal position of the floor plate on the magazine thereby ensuring the floor plate is properly located when fully mounted to the magazine tube.

Bottom wall 103 of floor plate 50 may have a stepped configuration defining a rear upper inclined ramp 105 and an adjoining forward upwardly open recessed receptacle 108 formed by a deeper front portion of the horizontally-extending channel 107. Receptacle 108 is closed at bottom by a lower forward spring arm seating surface 109 of the bottom wall 103 which is located at a lower elevation and lies in a different horizontal plane than at least the forward-most portion of the inclined ramp 105 adjacent to the receptacle. The spring arm seating surface 109 may be flat in one and abuttingly engages a corresponding flat bottom surface 97 of the spring arm 87 of spring base 80 when seated in the receptacle 108 when the floor plate is fully mounted on the tubular body 21 of the magazine 20. Inclined ramp 105 defines an upward facing top sloping surface 106 which slideably engages the bottom surface 97 of spring arm 80 when the floor plate 50 is mounted on the magazine tube. Ramp 105 and concomitantly sloping surface 106 slope downwards from front to rear as shown.

The angular stepped transition between inclined ramp 105 and receptacle 108 defines a sharply and acutely angled corner or shoulder which defines a generally V-shaped locking edge 90 of the floor plate 50. Edge 90 is arranged to engage corresponding V-shaped locking notch 89 of spring base 80 when the spring arm 87 is fully seated in receptacle 108 of the floor plate (see, e.g. FIG. 18). This forms an interlock which prevents the floor plate 50 from being horizontally removed from the tubular magazine body 21 back in the forward direction. Edge 90 may be straight extending laterally and linearly with a length which extends fully between sidewalls 104 of floor plate 50 (see, e.g. FIG. 37). A tooling hole 110 may be formed in bottom wall 103 of floor plate 50 within receptacle 108 to disassemble and remove the floor plate from the magazine. The end of a slender removal tool 111 such as a screwdriver, punch, rod, pin, or similar elongated tool is inserted through tooling hole 108 to engage the bottom surface 97 of spring base spring arm 87. Pushing upwards with the tool on the spring arm disengages the locking notch 89 of spring base 80 from locking edge 90 of floor plate 50, thereby allowing the floor plate to be pulled forward by the user and horizontally withdrawn from the magazine 20 in a forward horizontal direction H (perpendicular to magazine centerline CL).

Floor plate 50 may have a monolithic unitary structure in some embodiments in which all of the foregoing features described are integral parts thereof. The floor plate may be formed of any suitable non-metallic or metallic material for the application. In one embodiment, the spring base 80 may be formed of injection molded plastic.

A method or process for assembling magazine 20 will now be briefly described with primary reference to FIGS. 15-18. These figures show sequential cross-sectional views of the bottom portion of the magazine in the process of assembling the components thereof.

Figure 15:
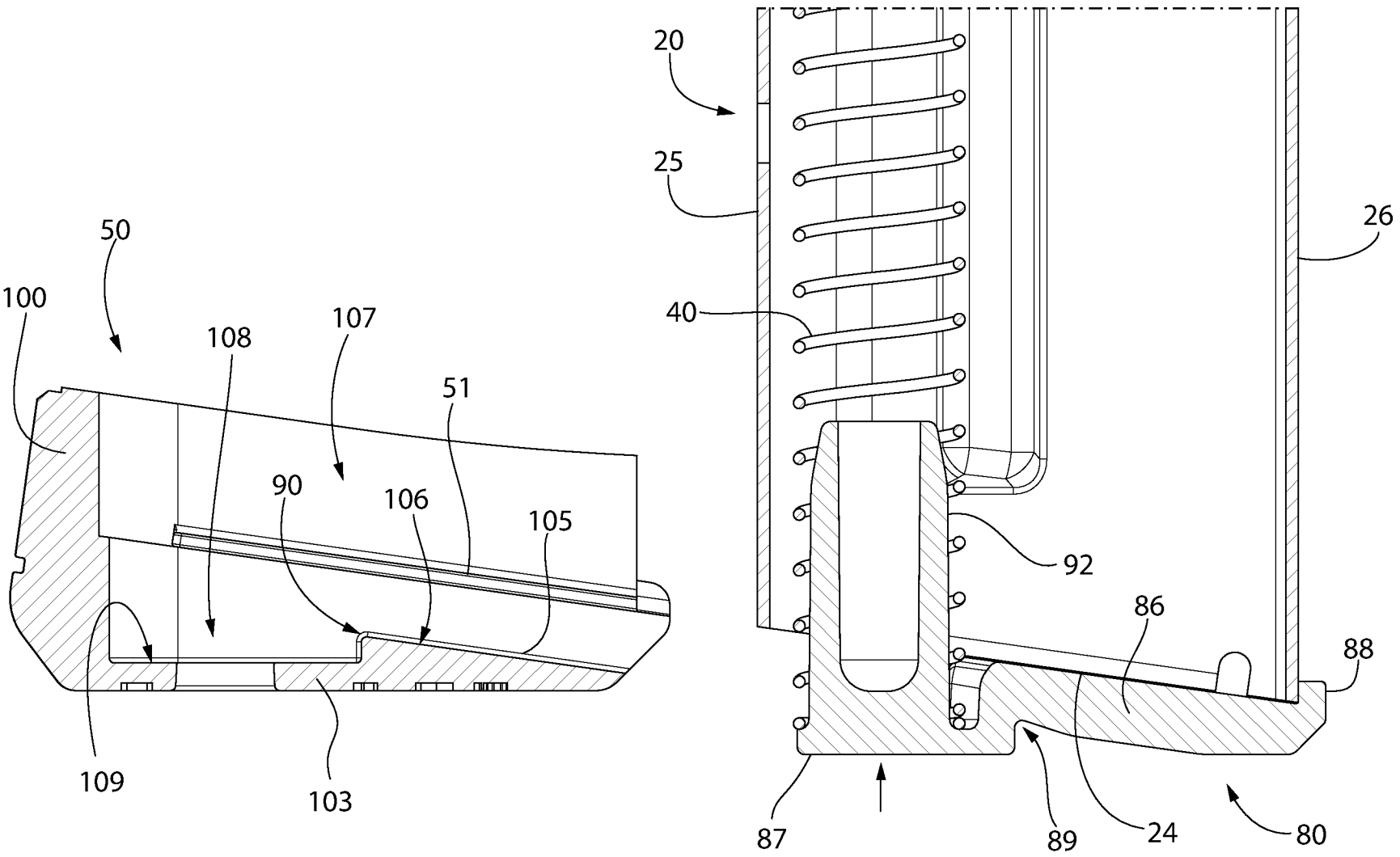
FIG. 15 is a first side cross sectional view of the magazine in a sequence of images demonstrating a non-limiting method for assembling the magazine.

Referring to FIG. 15, the method may include providing the tubular magazine body 21 and inserting follower 60 and magazine spring 40 into the cavity of 22 of magazine body. The magazine body may be held upside down to facilitate this process in some implementations of the method. Next, spring base 80 may be positioned on the bottom end of the magazine body. The spring base comprises the resiliently deformable spring arm 87 previously described herein defining circular spring seating surface 92*a* which engages and supports the spring when positioning the spring base on the magazine body. The spring retention protrusion 92 is inserted into the bottom end of spring 40 during the process. In variations of the method, the bottom end of the spring may be first inserted over the spring retention protrusion first and engaged with the seating surface 92*a* before inserting the spring into the magazine body cavity 22 and positioning the spring base 80 on the magazine body. Either approach may be used. The assembly created so far is shown in FIG. 15.

Figure 16:
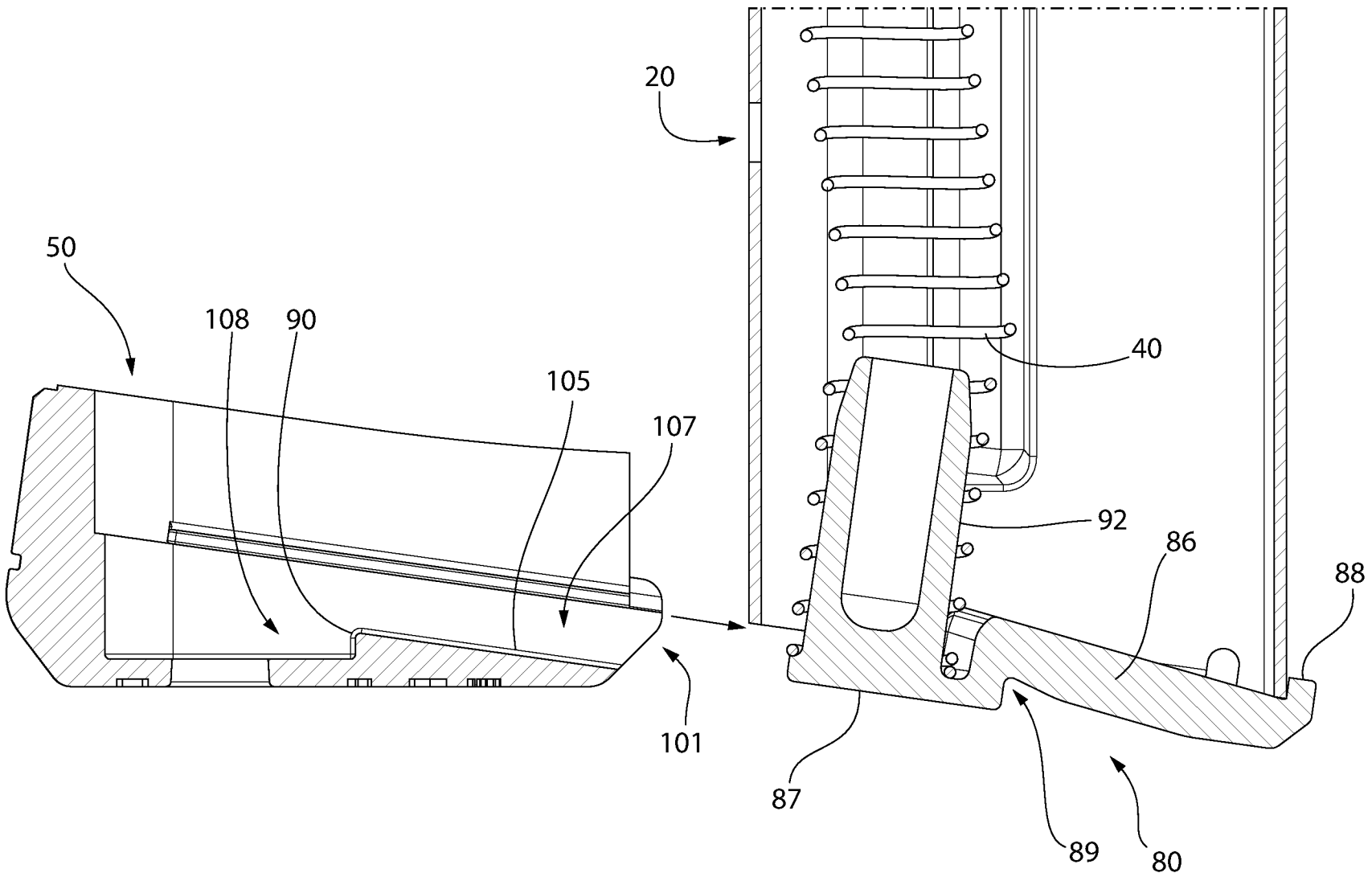
FIG. 16 is a second side cross sectional view of the magazine in the sequence.

Referring to FIG. 16, the magazine assembly method continues with sliding the floor plate 50 onto the bottom end 24 of the magazine body 21 in a horizontal rearward direction. The magazine body 21 followed by the forward spring arm 87 of spring base 80 enter the open rear end 101 and channel 107 of the floor plate. The pair of lateral flanges 29 on the body are inserted into the corresponding mounting grooves 51 of the floor plate. Engagement therebetween prevents the floor plate from being removed from the bottom end of the magazine body in a downward direction parallel to magazine vertical centerline CL.

Figure 17:
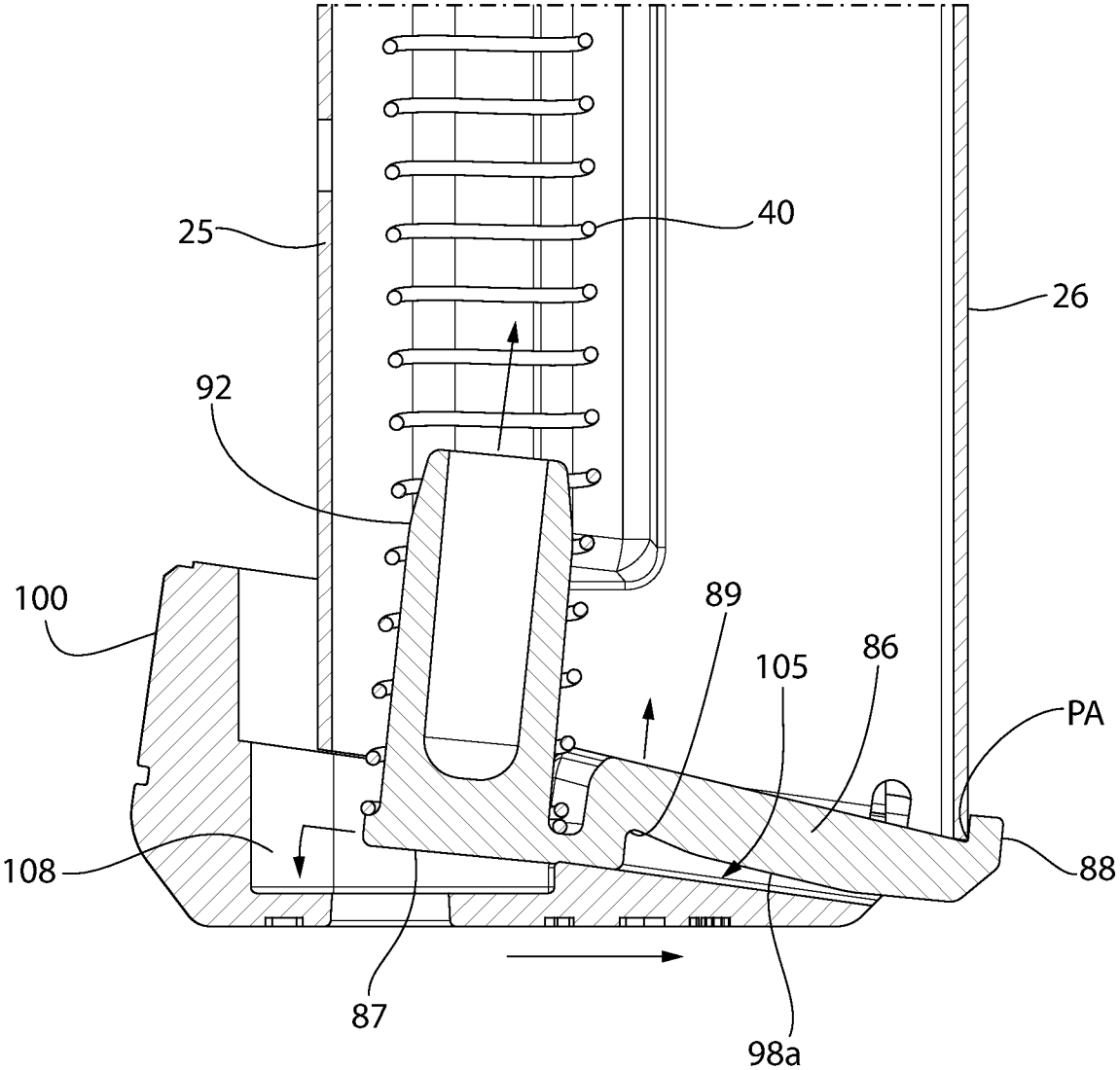
FIG. 17 is a third side cross sectional view of the magazine in the sequence.

Referring to FIG. 17, inclined ramp 105 slideably engages the spring arm 87 of spring base 80. The lowest rear portion of the ramp first engages the front of the spring arm. As floor plate 50 continues to be slid onto the bottom end of the tubular magazine body towards the rear, the spring arm 87 gradually slides along the inclined ramp 105 towards it forward-most end. This automatically and gradually raises the resiliently deformable spring arm from the lower undeflected position to the upper deflected position via engagement with the higher portions of the an inclined ramp of the floor plate. The spring base 80 and spring arm 87 pivot upwards about rear pivot axis PA (clockwise in FIG. 17) formed between raised lip 88 and bottom edge of rear wall 26 of the magazine body 21. The spring retention protrusion 92 moves upward farther into the magazine cavity 22. The forward part of rear portion 86 of spring base 80 also enters the magazine cavity slightly during the process.

Figure 18:
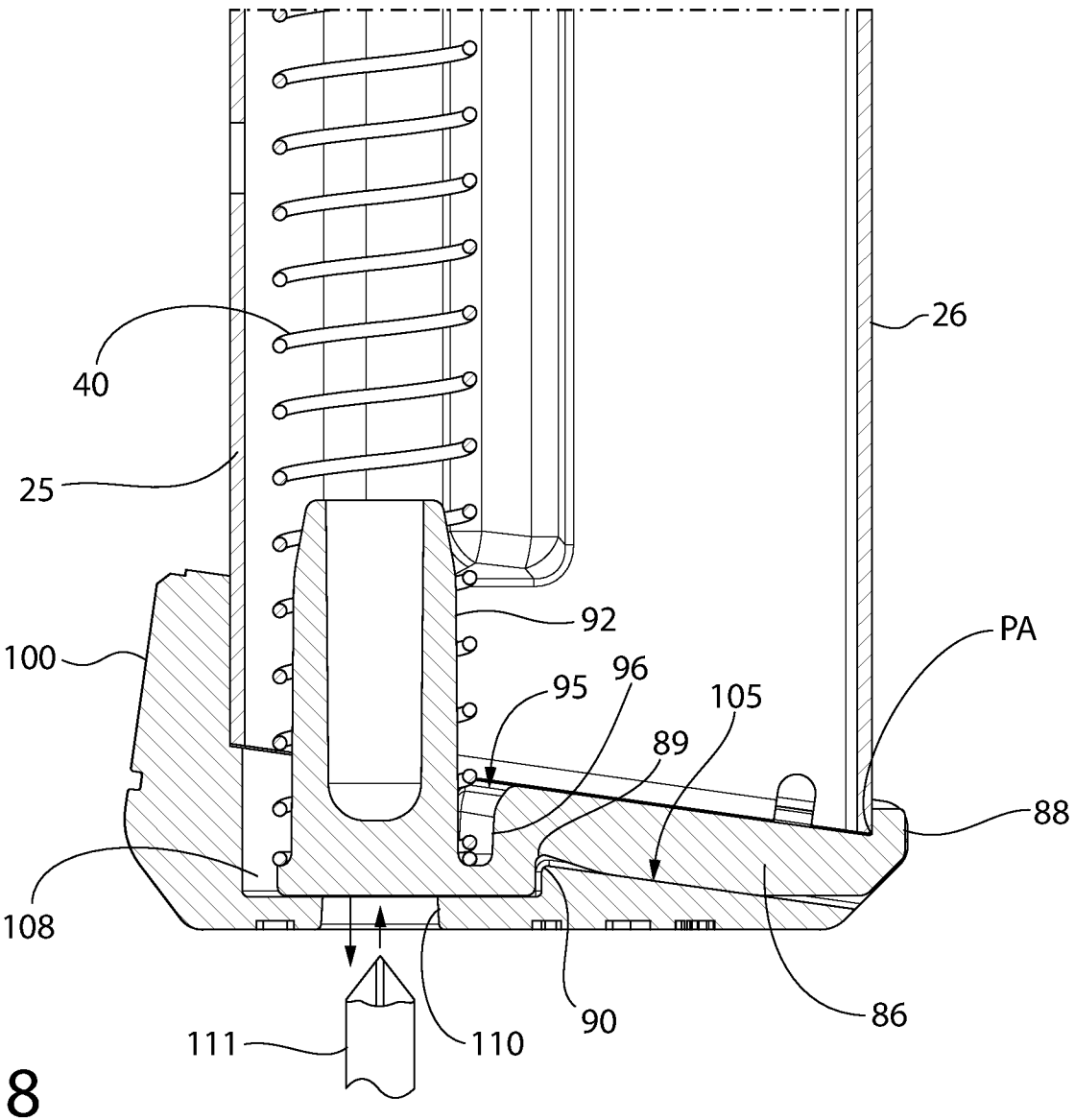
FIG. 18 is a fourth side cross sectional view of the magazine in the sequence.
Figure 19:
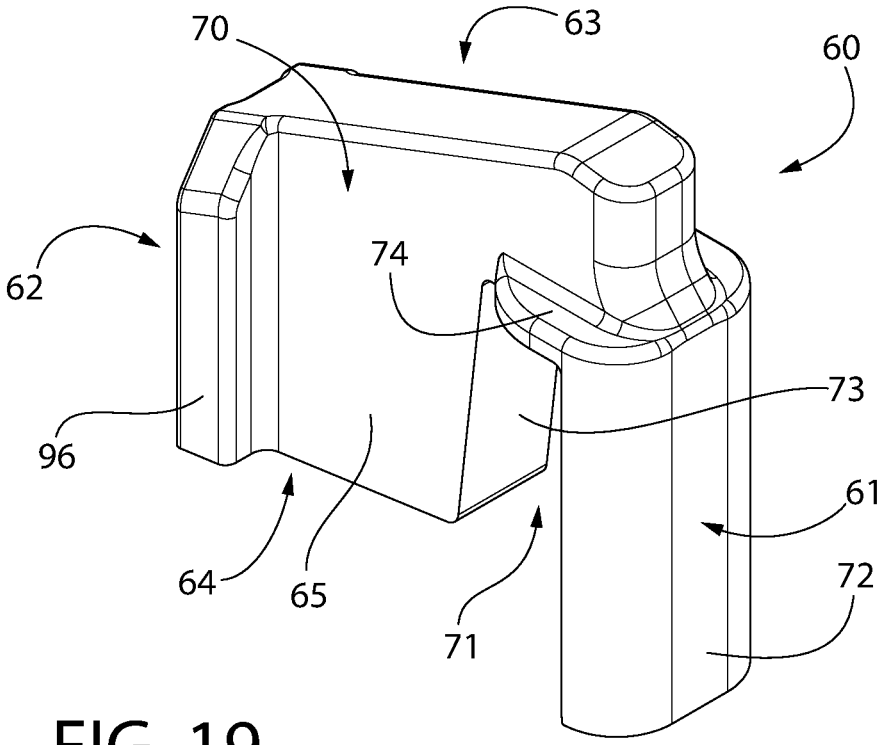
FIG. 19 is a front perspective view of the follower of the magazine.
Figure 20:
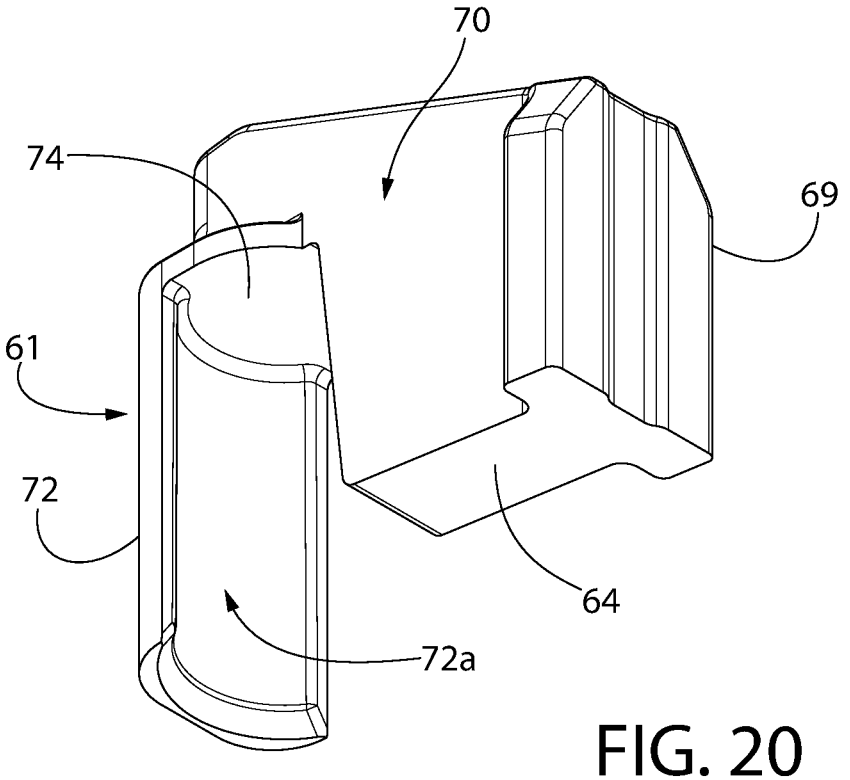
FIG. 20 is a rear perspective view thereof.
Figure 21:
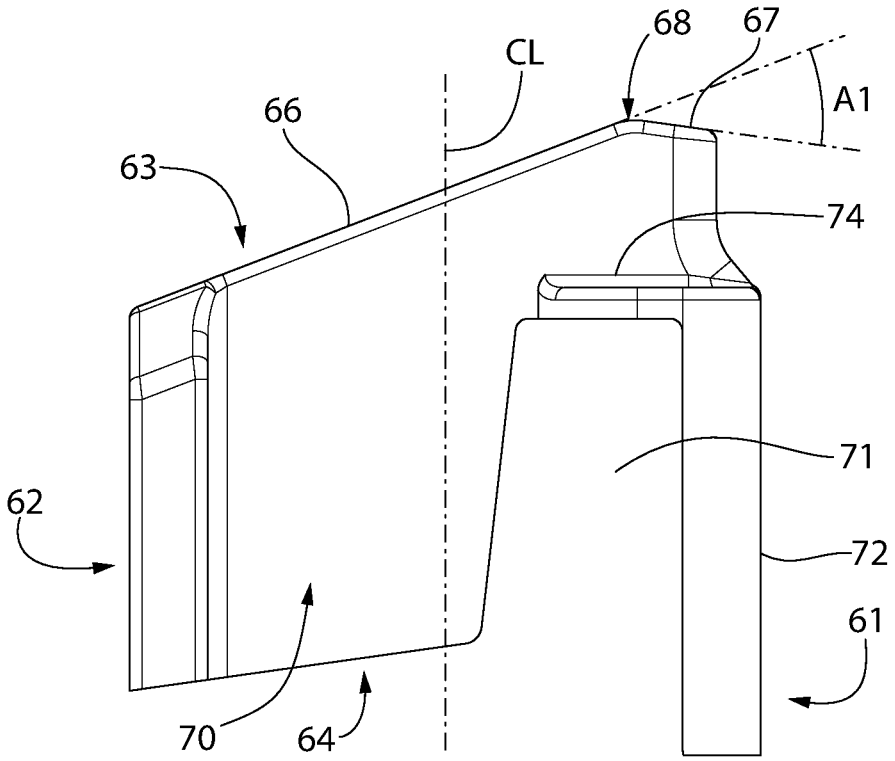
FIG. 21 is a right side view thereof.
Figure 22:
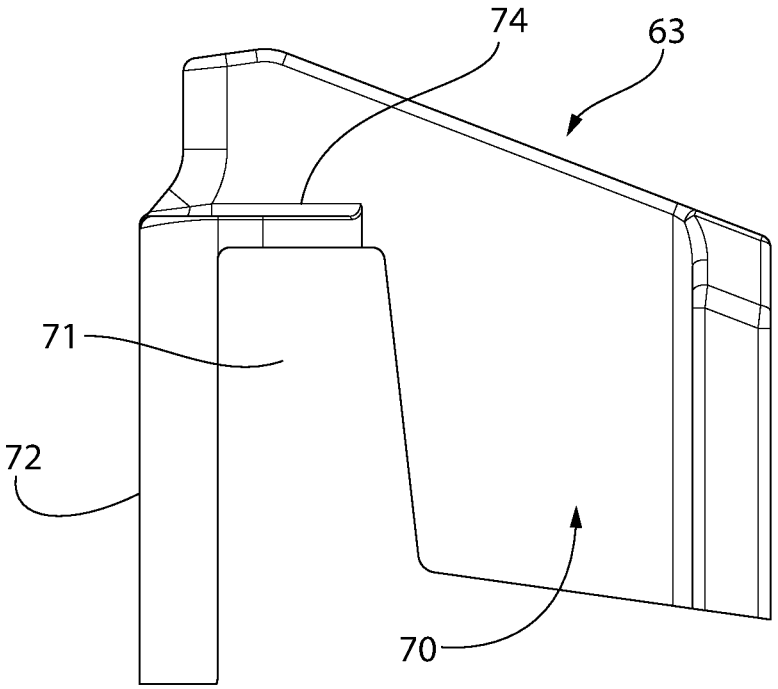
FIG. 22 is a left side view thereof.
Figure 24:
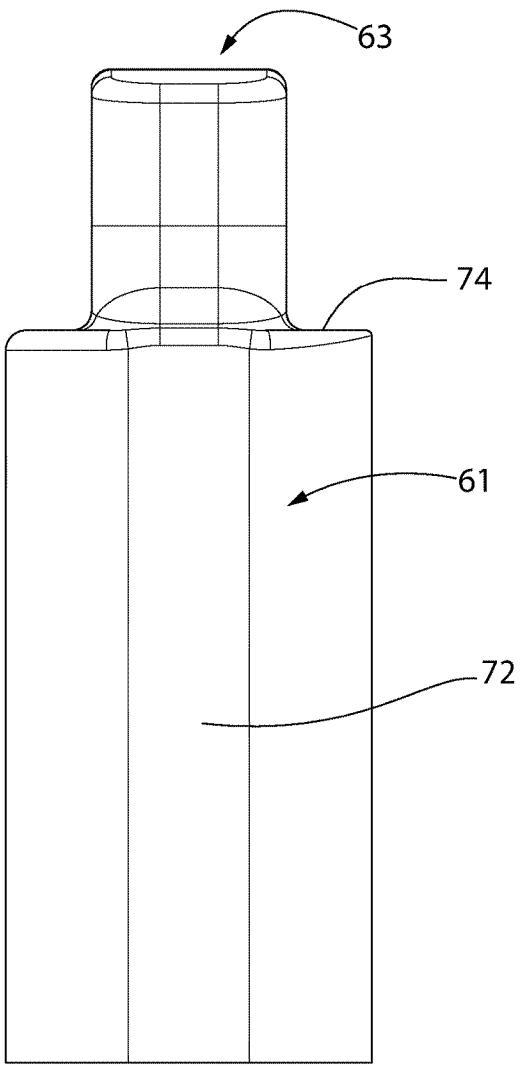
FIG. 24 is a front view thereof.
Figure 23:
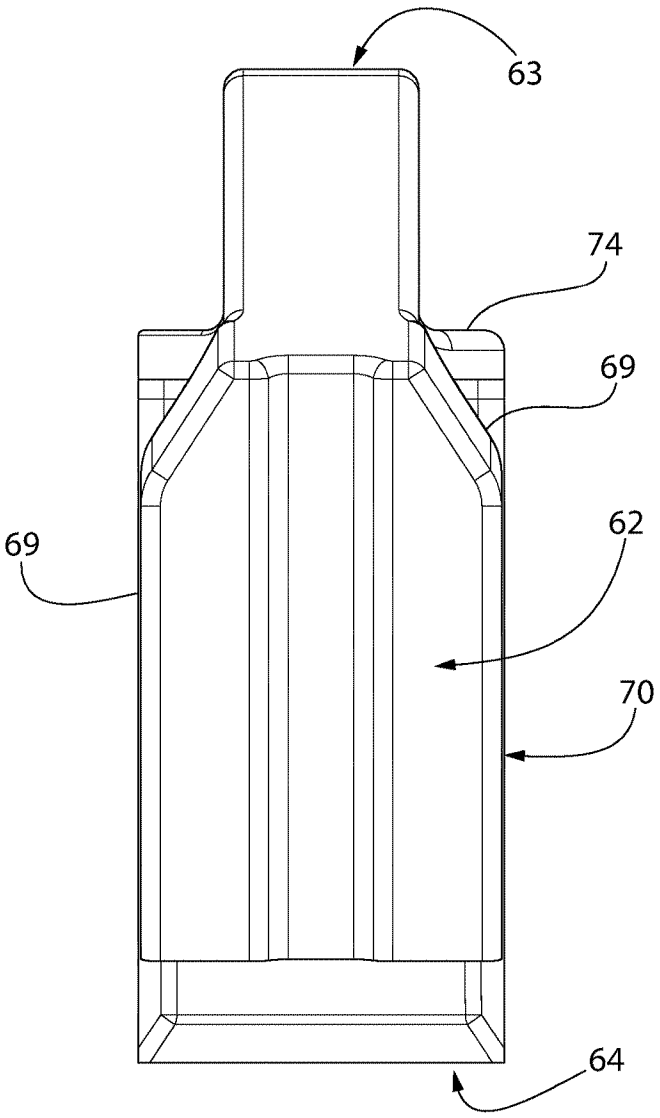
FIG. 23 is a rear view thereof.
Figure 25:
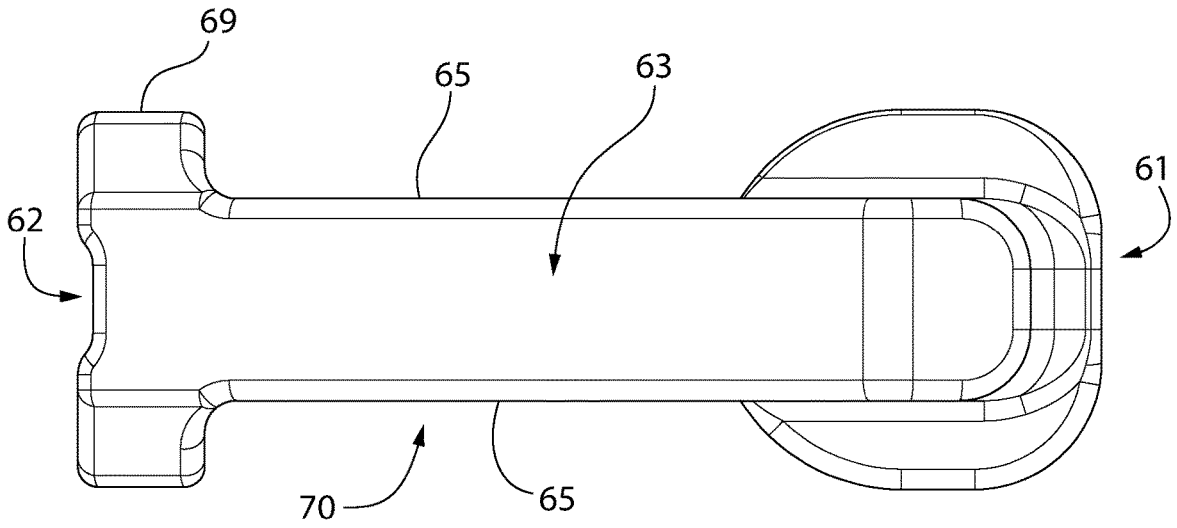
FIG. 25 is a top view thereof.
Figure 26:
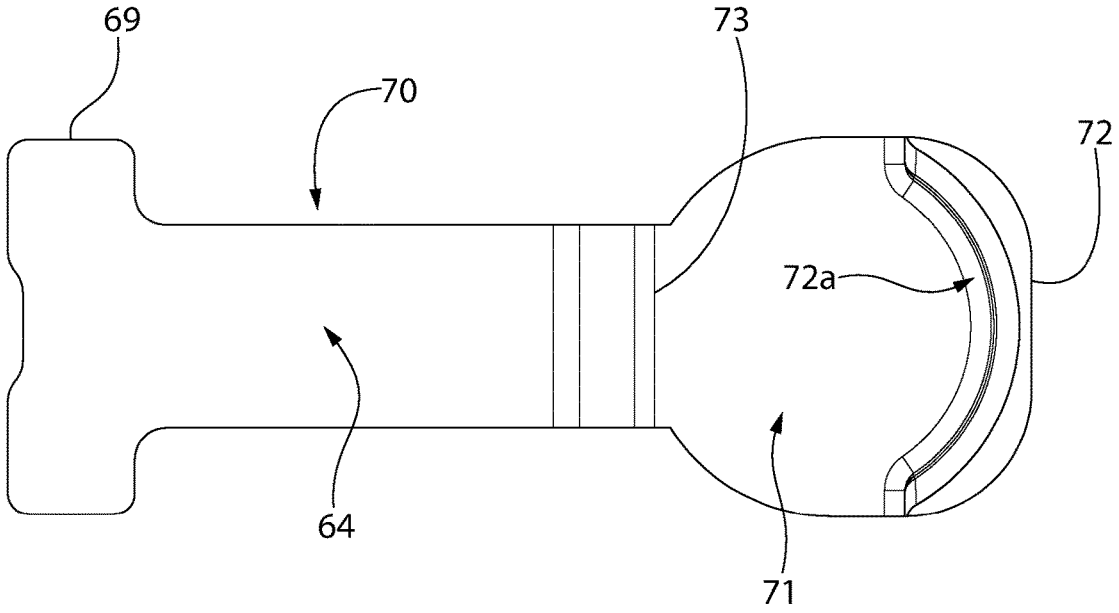
FIG. 26 is a bottom view thereof.
Figure 27:
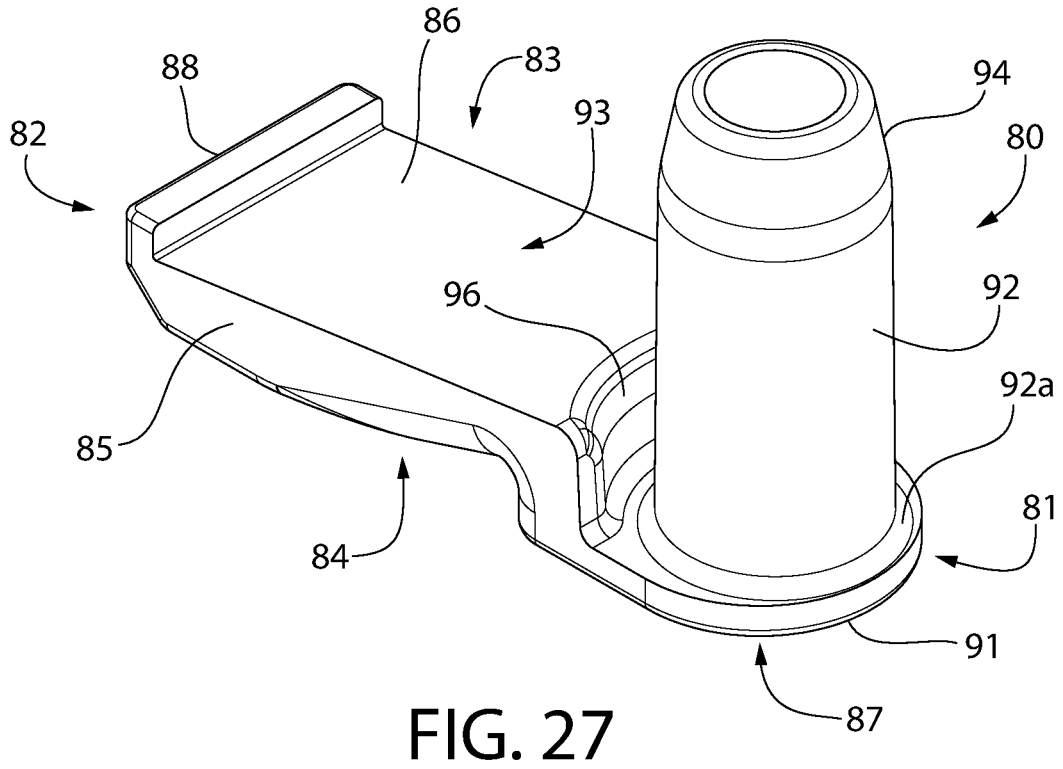
FIG. 27 is a front perspective view of the spring base of the magazine.
Figure 28:
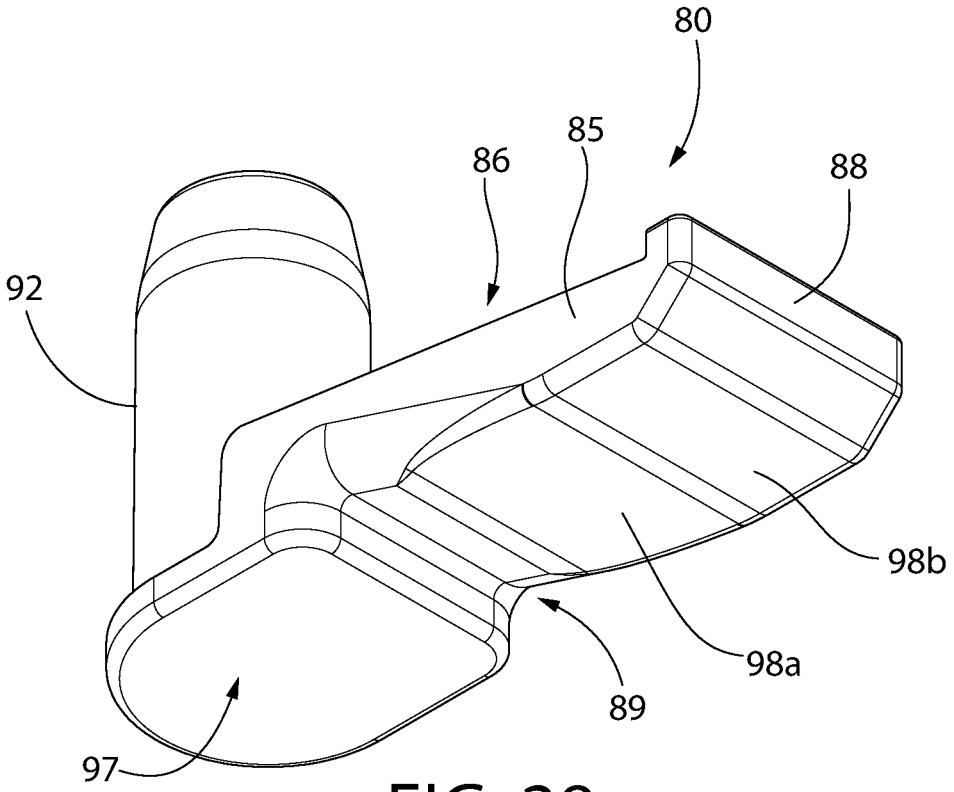
FIG. 28 is a rear perspective view thereof.
Figure 29:
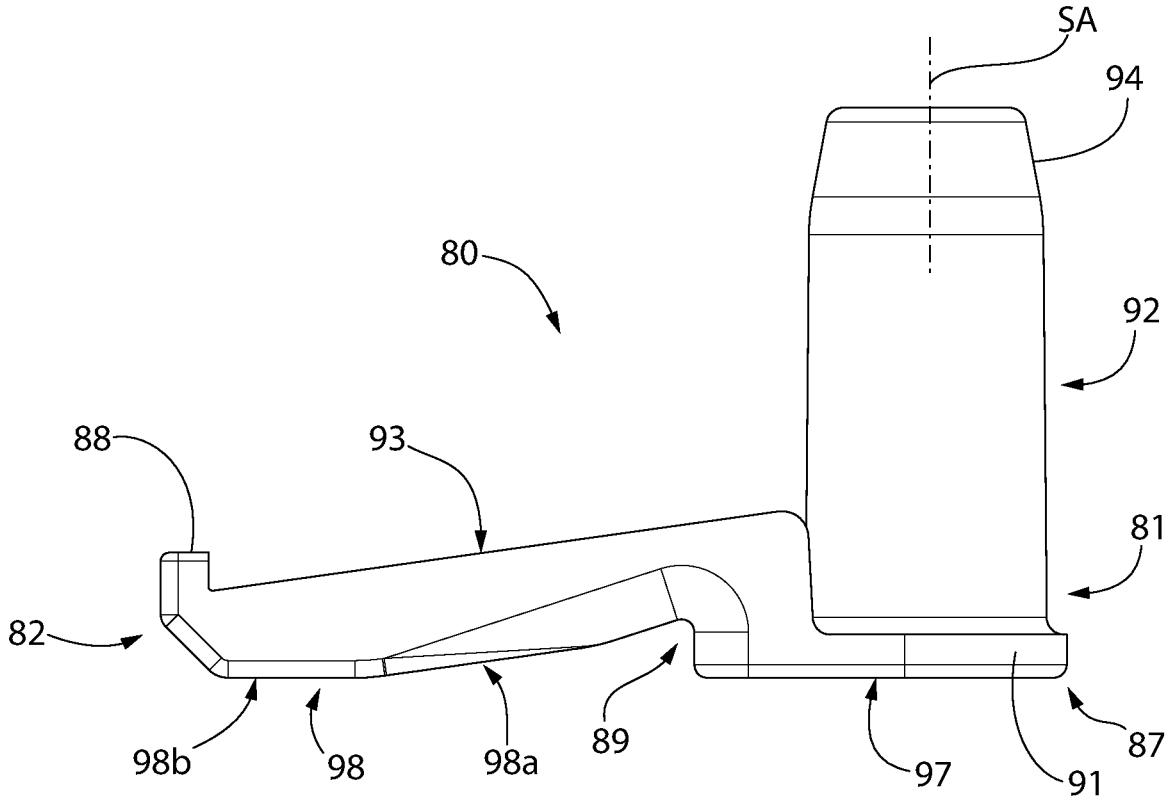
FIG. 29 is a right side view thereof.

Eventually, the rear end of the spring arm 87 at the stepped transition to the rear portion 80 of spring arm 80 reaches the front end of inclined ramp 105 of floor plate 50 as the floor plate continues to move rearward on the magazine body 21. When engagement between the inclined ramp and spring arm is finally broken, the spring arm snaps back downward to its initial undeformed lower undeflected position, which snap locks the spring arm into forward recessed receptacle 108 of the floor plate as shown in FIG. 18. The locking notch 89 of spring base 80 positive engages the corresponding locking edge 90 of floor plate 50. The bottom surface 97 of spring arm 87 abuttingly engages surface 109 of floor plate 50 within the receptacle. Advantageously, the floor plate 50 cannot be manually removed and withdrawn forwardly from the magazine body 21 in the horizontal direction. The front wall 100 of floor plate 50 which extends upwardly partially along the front wall 25 of the magazine body prevents the floor plate from being removed in the rearward direction as well. The floor plate 50 is now fully locked to and mounted on the tubular magazine body, and the magazine 20 is ready for loading cartridges 30 therein. It bears noting that the locking engagement is automatically created with an use of tools.

To detach and remove the floor plate 50, tool 111 may be inserted through tooling hole in the floor plate 50 by the user. Spring arm 87 of spring base 80 is manually moved via the tool 111 to the upper deformed and deflected position to the point where the bottom of the spring arm can clear the locking edge 90 at the front end of inclined ramp 50. While maintaining the deflected position, the user may now pull and slide floor plate 50 back forward to remove the floor plate from the tubular magazine body 21. The deflected position of the spring arm need only be maintained long enough until the bottom of the spring arm can re-engage the ramp 105 of floor plate 50, which is sufficient to prevent the spring arm from snap locking back into the floor plate receptacle 108.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A magazine for a firearm comprising:

an elongated tubular body defining a vertical centerline and an interior cavity configured to hold a stack of ammunition cartridges, the tubular body including a top end, a bottom end, a front wall, a rear wall, and opposed lateral sidewalls extending between the front and rear walls;

a rear portion of the top end of the body further comprising a pair of inwardly protruding cartridge feed lips configured to engage an uppermost cartridge in the stack;

a spring disposed in the cavity;

a follower moveably disposed in the cavity and biased in an upwards direction towards the top end by the spring;

a spring base detachably positioned on the bottom end of the tubular body, the spring base comprising a cantilevered spring arm supporting the spring, the spring arm being resiliently deformable between an undeflected position and a deflected position;

a floor plate slideably engageable with the bottom end of the body which retains the spring base on the tubular body;

wherein the floor plate is configured to automatically move the spring arm from the undeflected position to the deflected position when the floor plate is slid onto the bottom end of the tubular body;

wherein the spring defines a spring axis which is parallel to and offset from the vertical centerline of the body, the spring being configured and operable such that a top end of the spring acts solely on a front portion of the follower forward of the feed lips.

2. The magazine according to claim 1, wherein the floor plate includes an inclined ramp operable to slideably engage and raise the spring arm from the undeflected position to the deflected position when the floor plate is slid onto the bottom of the tubular body.

3. The magazine according to claim 2, wherein the inclined ramp is located on a rear portion of the floor plate and slopes in a downward direction from front to rear.

4. The magazine according to claim 2, wherein the inclined ramp of the floor plate is positioned to the rear of the spring arm when the floor plate is fully mounted on the tubular body of the magazine.

5. The magazine according to claim 4, wherein the spring is positioned forward of the inclined ramp when the floor plate is fully mounted on the tubular body of the magazine.

6. The magazine according to claim 2, wherein the inclined ramp defines a flat top sloped surface which engages a complementary angled flat sloped bottom surface section of the spring base forming a flat-to-flat interface therebetween.

7. The magazine according to claim 2, wherein the spring arm defines a V-shaped locking notch which lockingly engages a complementary configured locking edge of the floor plate forming an interlock which prevents the floor plate from being slideably removed from the tubular body of the magazine.

8. The magazine according to claim 7, wherein the spring arm is vertically offset from an elongated rear portion of the spring base.

9. The magazine according to claim 8, wherein the locking notch is formed on an underside of the spring base at a stepped transition between the rear portion of the spring base and the spring arm.

10. The magazine according to claim 7, wherein the floor plate includes a bottom wall defining an upwardly open recessed receptacle, the spring arm being seated on an upward facing lower surface within the receptacle when the floor plate is fully mounted on the tubular body of the magazine.

11. The magazine according to claim 10, wherein the bottom wall includes a tooling through hole in the receptacle providing access to the bottom surface of the spring arm for manually moving the spring arm from the undeflected position to the deflected position.

12. The magazine according to claim 10, wherein the locking notch of the floor plate is defined by a stepped transition between the inclined ramp and the recessed receptacle.

13. The magazine according to claim 1, wherein the spring arm has a semi-circular configuration.

14. The magazine according to claim 1, wherein the spring is a helical compression spring with circular coils.

15. The magazine according to claim 14, wherein the spring arm defines an upward facing spring seating surface which engages and supports a bottom coil of the spring.

16. The magazine according to claim 14, wherein the spring arm includes a cylindrical spring retention protrusion which engages a bottom end of the spring to retain the spring in position.

17. The magazine according to claim 1, wherein the spring is located proximate to the front wall of the tubular body.

18. The magazine according to claim 1, wherein the spring arm engages the spring and extends forwardly from a rear portion of spring base.

19. The magazine according to claim 18, wherein a rear end of the rear portion of the spring base comprises a raised lip which engages the rear wall of the tubular body of the magazine.

20. The magazine according to claim 2, wherein the floor plate includes a pair of grooves which slideably engage a corresponding pair of retention flanges on the bottom end of the tubular body.

21. The magazine according to claim 1, wherein the follower comprises a rear portion, a laterally enlarged front guide disk, and a front stabilizer wall extending downwardly from the guide disk, a gap between the rear portion and the stabilizer wall defining a spring receptacle which receives a top end of the spring.

22. The magazine according to claim 21, wherein the stabilizer wall extends below the rear portion of the follower.

23. A pistol defining a magazine well configured to receive the magazine according to claim 1.

24. The magazine according to claim 1, wherein a bottom end of the spring acts solely on the spring arm of the spring base.

25. The magazine according to claim 1, wherein the front portion of the follower on which the spring acts is positioned beneath a forward opening in the top end of the body forward of the feed lips.

26. The magazine according to claim 14, wherein the spring is located adjacent to the front wall of the body and disposed entirely forward of the feed lips.

27. The magazine according to claim 26, wherein the spring occupies only a front half of the cavity of the magazine.

28. The magazine according to claim 2, wherein the ramp of the floor plate is horizontally elongated and defines an upward facing sloped surface configured which slideably engages a bottom surface of the spring arm of the spring base.

29. The magazine according to claim 1, wherein the bottom end of the spring engages a spring seating surface of the spring arm which lies in a horizontal plane lower than an adjoining flat rear portion of the spring base.

30. The magazine according to claim 10, wherein an automatic snap interlock is automatically formed between the spring arm of the spring base and the receptacle of the floor plate when the floor plate is slid onto the body of the magazine without the use of a tool.

* * * * *